US007008509B1

(12) United States Patent
Otani et al.

(10) Patent No.: US 7,008,509 B1
(45) Date of Patent: Mar. 7, 2006

(54) MOLDED BODY WITH PROJECTED PART, DRY MOLD FOR MANUFACTURING THE MOLDED BODY, AND METHOD AND DEVICE FOR MANUFACTURING THE MOLDED BODY

(75) Inventors: Kenichi Otani, Tochigi (JP); Toshio Kobayashi, Tochigi (JP); Toshiharu Togashi, Yamagata (JP); Shingo Odajima, Tochigi (JP); Tokihito Sono, Tochigi (JP); Masayuki Osaki, Tochigi (JP); Hiromichi Kimbara, Tochigi (JP); Atsushi Sato, Tochigi (JP)

(73) Assignee: Kao Corporation, Tokyo (JP)

( * ) Notice: Subject to any disclaimer, the term of this patent is extended or adjusted under 35 U.S.C. 154(b) by 197 days.

(21) Appl. No.: 10/048,446

(22) PCT Filed: Aug. 4, 2000

(86) PCT No.: PCT/JP00/05261

§ 371 (c)(1),
(2), (4) Date: Jun. 24, 2002

(87) PCT Pub. No.: WO01/11141

PCT Pub. Date: Feb. 15, 2001

(30) Foreign Application Priority Data

Aug. 4, 1999 (JP) ..... 11/221797
Apr. 17, 2000 (JP) ..... 2000/115612

(51) Int. Cl.
*D21F 13/00* (2006.01)

(52) U.S. Cl. ..... 162/218; 162/220; 162/224; 162/226; 162/230; 162/387; 162/393; 162/401; 264/86; 264/87; 428/34.2

(58) Field of Classification Search ..... 162/218, 162/220, 224, 226, 230–231, 387, 393, 398, 162/401; 264/86, 87; 428/34.2
See application file for complete search history.

(56) References Cited

U.S. PATENT DOCUMENTS

| | | | | |
|---|---|---|---|---|
| 1,963,134 | A * | 6/1934 | Keiding | 162/220 |
| 2,116,198 | A * | 5/1938 | Hawley | 162/223 |
| 2,388,828 | A | 11/1945 | Chaplin | |
| 2,961,043 | A | 11/1960 | Hicks | |
| 4,088,259 | A | 5/1978 | Sutton | |

FOREIGN PATENT DOCUMENTS

| | | |
|---|---|---|
| CN | 2344422 Y | 10/1999 |
| GB | 2007583 | 7/1979 |
| JP | 35-9669 | 7/1960 |
| JP | 47-15522 | 5/1972 |
| JP | 52-34008 | 3/1977 |
| JP | 55-158399 | 12/1980 |
| JP | 2-127592 | 5/1990 |
| JP | 6-65900 | 6/1994 |

(Continued)

*Primary Examiner*—Mark Halpern
(74) *Attorney, Agent, or Firm*—Oblon, Spivak, McClelland, Maier & Neustadt, P.C.

(57) ABSTRACT

A molded body formed with pulp mold having projected lines corresponding to a slit-shaped vent package part, capable of being provided by paper-making/dewatering, using a paper making mold, a slurry having fibers dispersed in a liquid so as to obtain a three-dimensional fiber wetted laminated body, moving the laminated body to a dry mold having an inner surface with the slit-shaped vent package, and pressing and drying that laminated body.

3 Claims, 19 Drawing Sheets

FOREIGN PATENT DOCUMENTS

| | | |
|---|---|---|
| JP | 6-158599 | 6/1994 |
| JP | 7-16945 | 1/1995 |
| JP | 7-42100 | 2/1995 |
| JP | 7-223230 | 8/1995 |
| JP | 8-049200 | 2/1996 |
| JP | 9-132900 | 5/1997 |
| JP | 9-296397 | 11/1997 |
| JP | 2000-34699 | 2/2000 |

* cited by examiner 7
5
4
40
6
8
50
9

1
3
8
13

MOLDED BODY WITH PROJECTED PART, DRY MOLD FOR MANUFACTURING THE MOLDED BODY, AND METHOD AND DEVICE FOR MANUFACTURING THE MOLDED BODY

This Application is a 371 of PCT/JP00/05261 filed 4 Aug. 2000.

TECHNICAL FIELD

The present invention relates to a molded article with ridges, a drying mold for producing molded articles, a method of producing molded articles, and an apparatus for producing molded articles.

BACKGROUND ART

Pulp molded articles have been extending their use, taking the place of plastic molded articles from the environmental considerations. Pulp molded articles are produced by, for example, a method including a papermaking step in which a pulp slurry is fed to the papermaking side of a papermaking mold having a plurality of holes and sucked through the holes to accumulate pulp on the papermaking side to form a wet preform, a dewatering step in which the wet preform as molded in the papermaking step is dewatered, and a drying step in which the dewatered and yet undried preform as obtained in the dewatering step is put into a drying mold and press-dried. It is desirable for the molded article thus prepared to have narrow ridges on its outer side which will function as nonslip or reinforcing ribs to provide ease of handling and shape retention. A technique for forming ridges on the surface of a pulp molded article is disclosed in JP-A-9-132900. According to this technique, a papermaking mold having narrow grooves is used to form ridges corresponding to the grooves on the surface of a molded article in the papermaking step.

Where ridges are formed on the surface of a molded article during papermaking as in the above-described technique, a dewatering mold or a drying mold used in the subsequent dewatering or drying step must have narrow grooves of slit form corresponding to the ridges. Besides, the ridges must be accurately fitted into the grooves so as not to deform the wet and therefore easily deformable preform as obtained by papermaking, especially the exterior ridges thereof. Such registration is extremely difficult. JP-A-6-158599 discloses a technique in which a drying mold having core vents for steam escape passage is used to increase drying efficiency. The drying mold proposed is incapable of forming narrow ridges. That is, because projections are apt to trap steam during drying and cause so-called steam explosion, it has been difficult to form projections having a high density up to their tips (apices).

DISCLOSURE OF THE INVENTION

Accordingly, an object of the present invention is to provide a molded article having high shape retention on use and handling properties with a handling device, a drying mold used to produce the molded article, a method of producing the molded article, and an apparatus for producing the molded article.

The present invention accomplishes the above object by providing a molded article obtained by the method comprising the steps of making a slurry containing fibers dispersed in a liquid into a three-dimensional fiber preform by use of a papermaking mold and then drying said fiber preform by use of a drying mold, wherein said molded article has a plurality of narrow ridges of prescribed height on the outer surface thereof.

The present invention also accomplishes the above object by providing a drying mold for producing a molded article having a drying part the shape of which fits an undried fiber preform and which has a plurality of narrow fluid passageways of slit form.

The present invention also accomplishes the above object by providing a method of producing a molded article which comprises a papermaking step in which a slurry containing fibers dispersed in a liquid is made into a wet fiber preform by use of a papermaking mold, a dewatering step in which said wet fiber preform is dewatered, and a drying step in which said dewatered undried fiber preform is dried by use of a drying mold, wherein said drying mold has on the inner side thereof a plurality of narrow fluid passageways of slit form, and said dewatered fiber preform is put into said drying mold, and pressed and dried to obtain a molded article having narrow ridges on the outer surface thereof at positions corresponding to said passageways.

The present invention also accomplishes the above object by providing an apparatus for producing a molded article which comprises a first mold and a second mold each split into two halves, wherein:

one of the halves each of the first and the second molds are fixed to the same side of a slide platen which slides reciprocally in the width direction of said halves, the other halves each of the first and the second molds are separately fixed on the same side of movable platens, said movable platens are reciprocally movable in the direction perpendicular to the parting faces of the halves fixed to said slide platen, the two halves fixed to said slide platen and the half of said second mold fixed to said movable platen each have a holding means for a molded article, said slide platen moves to bring the half of said first mold which is fixed thereto and the half of said second mold which is fixed to said movable platen face to face with each other, and these facing halves are closed and then opened by the reciprocal movement of said movable platens.

BRIEF DESCRIPTION OF THE DRAWINGS

FIGS. 2A and 2B show the drying mold of the first embodiment, in which FIG. 2A is a front view from the parting face side, and FIG. 2B is a longitudinal section.

FIGS. 3A through 3D schematically illustrate the papermaking and dewatering steps in the method of producing a molded article according to the first embodiment, in which FIG. 3A is the step of charging a slurry and dewatering, FIG. 3B is the step of inserting a pressing member, FIG. 3C is the step of pressing and dewatering, and FIG. 3D is the step of removal from a mold.

FIGS. 4A through 4G schematically illustrate transfer from the step of papermaking and dewatering to the step of drying in the method of producing a molded article according to the first embodiment, seen from above, wherein FIG. 4A is the stage before removal from the mold in the step of papermaking and dewatering, FIG. 4B is the stage in which a half of the split mold is separated, FIG. 4C is the stage in which the half of the split mold faces a drying mold, FIG. 4D is the stage in which the half of the split mold and the drying mold are joined, FIG. 4E is the stage in which the half of the split mold is separated, FIG. 4F is the stage in which the drying mold faces another drying mold, and FIG. 4G is the stage in which the two drying molds are joined.

FIGS. 5A through 5D schematically illustrate the step of drying in the method of producing a molded article according to the first embodiment, in which FIG. 5A is the step of placing a molded article, FIG. 5B is the step of inserting a pressing member, FIG. 5C is the stage of press-drying, and FIG. 5D is the step of removal from the mold.

FIGS. 8A and 8B show the drying mold of the second embodiment (corresponding to FIGS. 2A and 2B), in which FIG. 8A is a front view from the parting face side, and FIG. 8B is a longitudinal section.

FIGS. 13A and 13B show the drying mold of the fourth embodiment (corresponding to FIGS. 2A and 2B), in which FIG. 13A is a front view from the parting face side, and FIG. 13B is a longitudinal section.

BEST MODE FOR CARRYING OUT THE INVENTION

The present invention will be described with respect to preferred embodiments thereof while referring to the accompanying drawings.

Figure 1:
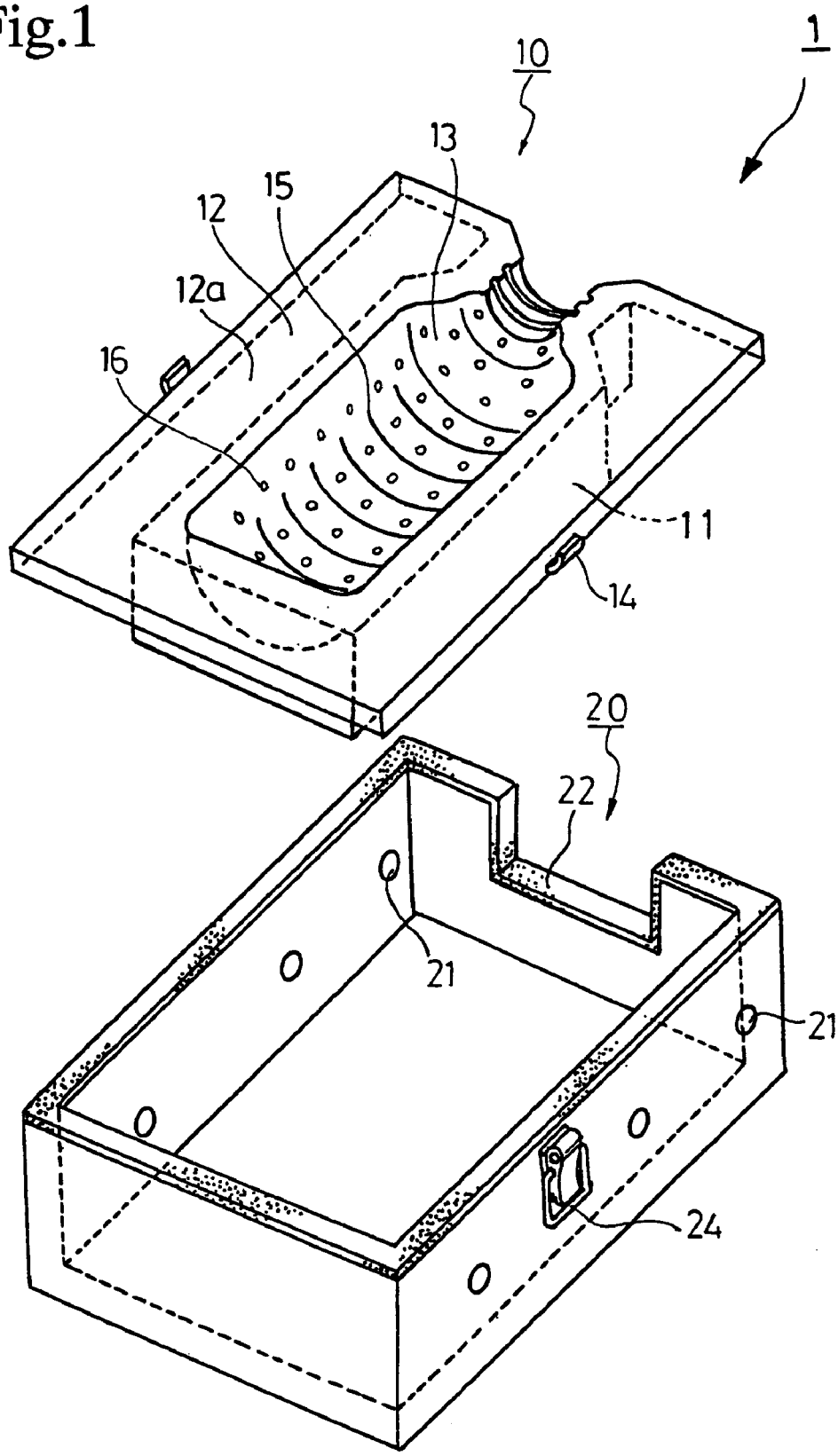
FIG. 1 is an exploded perspective of a drying mold according to a first embodiment of the present invention.
Figure 2A:
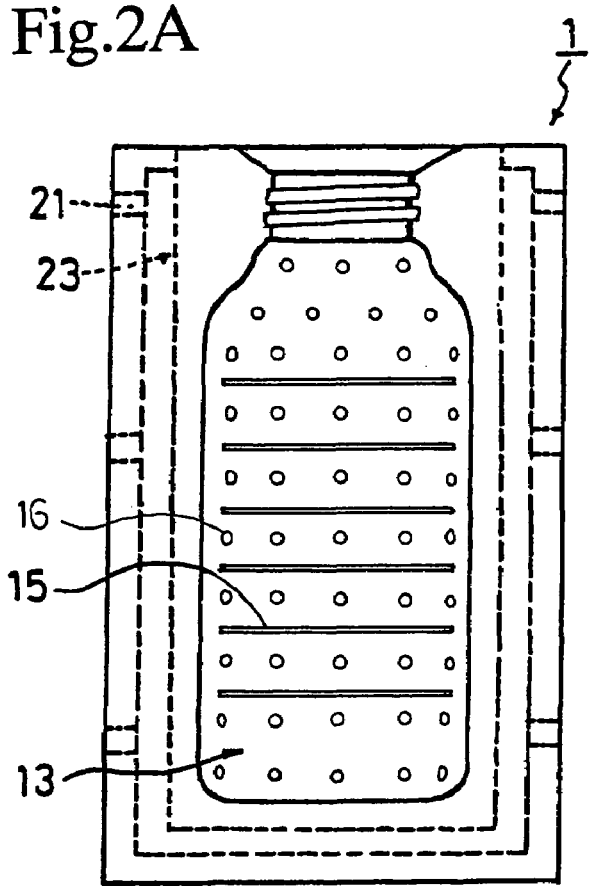
Figure 2B:
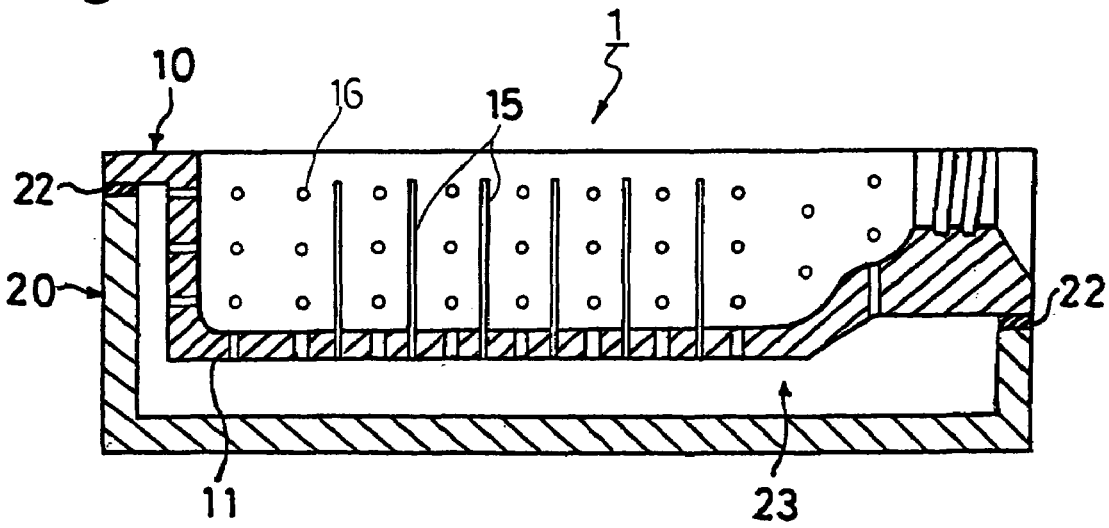

FIG. 1 is an exploded perspective of a drying mold according to a first embodiment of the present invention. FIGS. 2A and 2B are a front view, seen from the parting face side, and a longitudinal section of the drying mold of FIG. 1, respectively.

A drying mold 1 according to this embodiment is used to dry a wet fiber preform obtained by pulp molding techniques. The drying mold 1 is composed of a fiber preform holding member (hereinafter simply referred to as a holding member) 10 and a manifold member 20. The holding member 10 has a block 11 which is rectangle in its plan view and a flange 12 of plate form which extends from the upper edge of the block 11 to three horizontal directions. The block 11 has on its upper side a concave drying part 13 that fits a vertical half of a wet fiber preform molded by a prescribed method. A fiber preform is put into the drying part 13. The flange 12 has a flat upper surface 12*a*, which is a parting face (a face to be joined with another) of the drying mold 1. There is provided no papermaking net on the surface of the drying part 13 of the drying mold 1 according to this embodiment. The fiber preform holding member 10 can be made of a metal such as aluminum. While not shown, the block 11 has a heating means for heating the drying part 13 of the drying mold 1.

The manifold member 20 is a rectangular box in which the holding member 10 is fitted. Both longer side walls of the manifold member 20 have suction holes 21 interconnecting the inside and the outside. A sealer 22 is provided on the face of the manifold member 20 which comes into contact with the holding member 10. The sealer 22 keeps the hollow chamber (described below) airtight to prevent reduction of suction efficiency of the hollow chamber.

On fitting the holding member 10 to the manifold member 20, there is formed a hollow chamber 23 therebetween. The hollow chamber 23 connects to the outside through the suction holes 21 and also to the drying part 13 of the holding member 10 through fluid passageways 15 of slit form (hereinafter described).

With the holding member 10 and the manifold member 20 fitted together, a ring 24 provided on the manifold member 20 is fastened onto a hook 14 provided on the holding member 10 to removably fix the holding member 10 to the manifold member 20. Seeing that the shape of the drying part 13 of the holding member 10 is subject to variation according to the contour of a molded article to be produced, this manner of removably fixing the holding member 10 to the manifold member 20 is beneficial because such variations can be coped with by changing only the holding member 10 for every switch of product designs. There is no need to prepare a drying mold as a whole for every design of molded articles.

In the present embodiment, the drying mold 1 shown in FIGS. 1 and 2 is used as paired with another. A pair of the drying molds 1 are joined at their parting faces to form a cavity, in which a wet fiber preform is placed to carry out drying.

The drying mold 1 has a plurality of fluid passageways 15 of slit form which extend substantially horizontally around the periphery in the portion corresponding to the body of a preform set in the drying part 13. The passageways 15 are arrayed in the vertical direction at a prescribed interval. The passageways 15 interconnect the drying part 13 and the hollow chamber 23 so that steam may escape without causing steam explosion and that ribs may be formed on the outer surface of a molded article of prescribed size and shape. Either end of the slits as the passageways 15 does not reach the parting face so that gas leaks along the parting face can be suppressed when the fiber preform is transferred between the papermaking mold and the drying mold or when a molded article is removed from the drying mold by compressed air feed and suction through the passageways.

The fluid passageways of slit form can easily be made in a short time by means of an electric discharge wire cutter, a laser, etc. They can be made with ease even in a portion with a complicated shape, such as a threaded neck portion or a patterned body portion.

The width of the slit (the fluid passageways on the surface of the drying part 13) is preferably 0.05 to 5 mm, still preferably 0.1 to 2 mm, particularly preferably 0.1 to 0.5 mm, for obtaining improved appearance of a molded article, ease of making passageways, ease of maintaining the passageways, and the like. If the width of the passageways exceeds 5 mm, the inner and outer surfaces of the resulting molded article tend to become uneven, making it difficult to provide a coating on the inner and outer surfaces of the molded article efficiently.

The width of the passageways on the surface of the drying part 13 taken as a, and that on the backside of the drying part 13 (the side facing the manifold member 20) as b, it is desirable that $a \leqq b$ for preventing the passageways from being clogged with pulp dust, etc. and for obtaining increased efficiencies in vapor discharging and drying. Namely, a section of the passageways taken along the depth direction preferably depicts straight lines or tapered lines. Particularly preferably, $a<b$. In this case, $b/a$ is preferably 1.5 to 40, particularly 10 to 30, for further increasing efficiencies in vapor discharging and drying.

The opening ratio of the passageways 15 of slit form to the area of the drying part 13 preferably ranges from 0.5 to 70%, particularly 2 to 70%, from the standpoint of vapor discharging efficiency and a uniform degree of drying. Variation of the degree of drying from place to place tends to cause deformation of the molded article. The drying part 13 and the parting face are preferably coated with Teflon, etc. for easy release of the molded article and for easy maintenance of the mold.

In order to increase the drying efficiency, the drying part 13 preferably has a large number of vent holes 16 in addition to the passageways 15 of slit form.

By use of the drying mold 1 according to the present embodiment, narrow ridges of desired width can be formed on the outer surface of a molded article without involving steam explosion and without making depressions on the inner surface of the molded article in the positions corresponding to the ridges. Since either end of the passageways 15 does not reach the parting face, air leaks along the parting face 12*a* can be suppressed when the fiber preform is transferred between the papermaking mold and the drying mold or when a molded article is removed from the drying mold by purging with compressed air simultaneously with suction through the passageways. Molded articles can thus be produced in a stable manner.

Figures 3A, 3B, 3C, 3D:
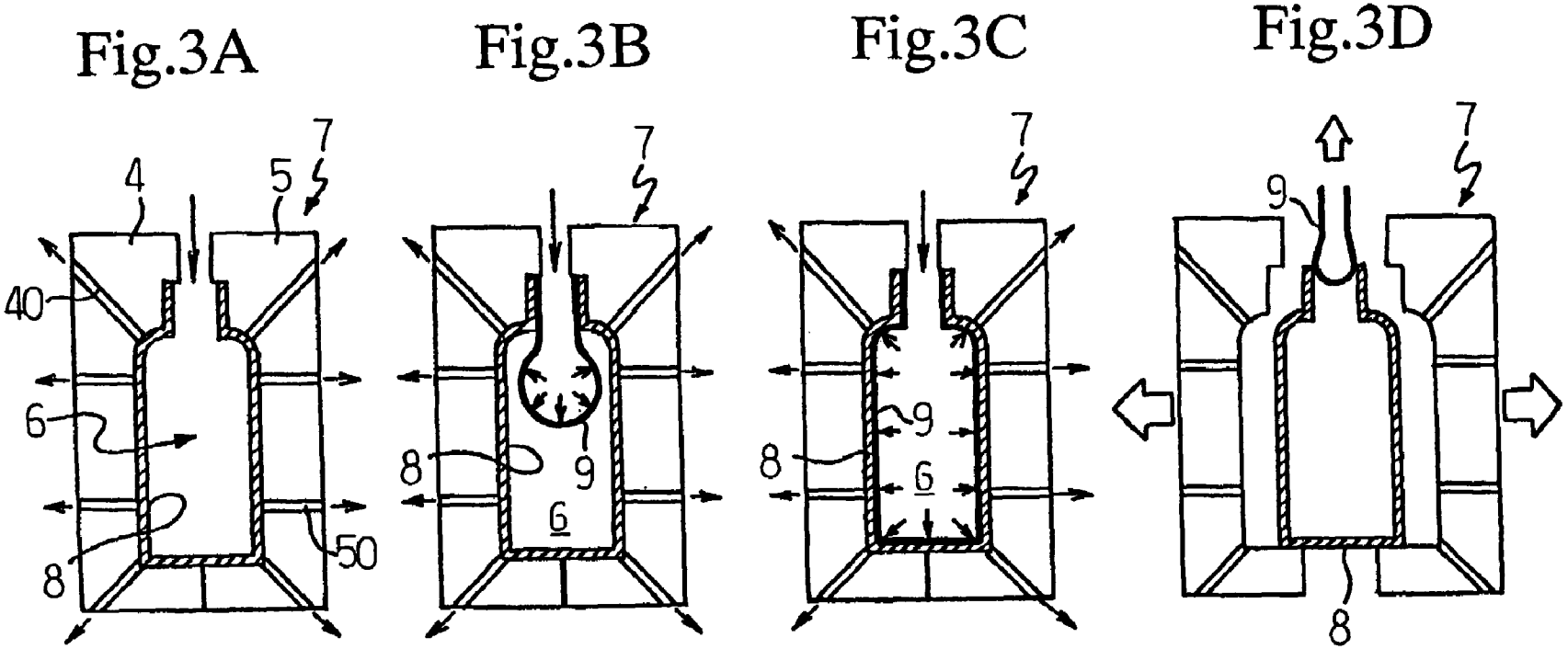

The method of producing a molded article according to the present invention will then be described with respect to its preferred embodiments by referring to the accompanying drawings. FIGS. 3A to 3D schematically illustrate the method of producing a molded article according to the first embodiment of the invention, in which FIG. 3A is the step of charging a pulp slurry and dewatering, FIG. 3B is the step of inserting a pressing member, FIG. 3C is the step of pressing and dewatering, and FIG. 3D is the step of removal from the mold. In FIGS. 3A to 3D, the structure, the shape and the like of the papermaking mold are schematically sketched for the sake of convenience.

A papermaking mold 7, split into two halves 4 and 5 having suction holes 40 and 50, is closed to form a cavity 6 corresponding to the contour of an article to be molded as shown in FIG. 3A. A slurry mainly comprising pulp (hereinafter referred to as a pulp slurry) is fed under pressure, i.e., injected from the upper opening. Injection of the pulp slurry is effected with, for example, a pressure delivery pump. The injection pressure of the pulp slurry is preferably 0.01 to 5 MPa, still preferably 0.01 to 3 MPa.

After the pulp slurry is fed until the slurry in the cavity 6 reaches a prescribed amount, dewatering by suction of the pulp slurry through the suction holes 40 and 50 is commenced. The water content of the pulp slurry is thus discharged out of the papermaking mold 7, and meanwhile pulp fiber is accumulated on the inner surface (inner surface of a papermaking net) of the cavity 6 to build up a hollow fiber preform 8 made of a pulp layer on the inner wall of the cavity 6.

The pulp fiber used in the pulp slurry can be of general type commonly employed in the manufacture of this type of pulp molded articles. The pulp slurry can consist of pulp fiber and water and, if desired, additionally contain other components such as inorganic substances, e.g., talc and kaolinite, inorganic fibers, e.g., glass fiber and carbon fiber, powder or fiber of synthetic thermoplastic resins, e.g., polyolefins, non-wood or plant fibers, and polysaccharides. The amount of these other components is preferably 1 to 70% by weight, particularly 5 to 50% by weight, based on the total amount of the pulp fiber and the components. The pulp slurry preferably has a pulp concentration of 0.1 to 5% by weight, particularly 0.3 to 3% by weight.

On forming a fiber preform having a prescribed thickness, an elastic inflatable hollow pressing member 9 is inserted into the cavity 6 while evacuating the cavity 6 by suction as shown in FIG. 3B. The pressing member 9 is to be inflated in the cavity 6 like a balloon to press the wet fiber preform 8 made of a pulp layer toward the inner wall of the cavity 6 thereby to transfer the inner configuration of the cavity 6. The pressing member 9 is made of a flexible film of urethane, fluororubber, silicone rubber, elastomers, etc., which are excellent in tensile strength, impact resilience, stretchability, and the like.

As shown in FIG. 3C, a pressurizing fluid is fed into the pressing member 9 to inflate it. The inflated pressing member 9 presses the wet fiber preform 8 to the inner wall of the cavity 6. While the fiber preform 8 is pressed onto the inner wall of the cavity 6 by the inflated pressing member 9, the configuration of the inner wall of the cavity 6 is transferred thereto, and dewatering further proceeds concurrently. Since the wet fiber preform 8 is pressed from its inside to the inner wall of the cavity 6 in this manner, the inner configuration of the cavity 6 can be transferred to the exterior surface of the fiber preform 8 with accuracy however complicated the configuration of the inner wall of the cavity 6 may be. Involving no step of joining molded pieces unlike conventional pulp molding methods, the resulting molded article has no seams nor thick-walled parts due to such joining. As a result, the resulting molded article has secured strength and a satisfactory appearance. The pressurizing fluid for inflating the pressing member 9 includes compressed air (heated air), oil (heated oil) and other various liquids. The pressure for feeding the pressurizing fluid is preferably 0.01 to 5 MPa, particularly 0.1 to 3 MPa.

In dewatering the fiber preform 8, air may be blown into the inside of the fiber preform 8 instead of using the above-described pressing member 9. Blown air presses the fiber preform 8 onto the inner surface of the cavity 6 to dewater the fiber preform 8 and also transfer the inner configuration of the cavity 6 to the fiber preform 8.

After the configuration of the inner wall of the cavity 6 is sufficiently transferred to the fiber preform 8 made of a pulp layer, and the fiber preform is dewatered to a prescribed water content, the pressurizing fluid is withdrawn from the pressing member 9, whereupon the pressing member 9 shrinks automatically to its original size as shown in FIG. 3D. The shrunken pressing member 9 is taken out of the cavity 6, and the papermaking mold 7 is opened to remove the fiber preform 8 which is still undried with the prescribed water content. The undried fiber preform thus taken out is then subjected to a press drying step.

Figure 4A:
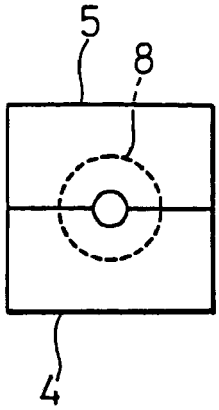
Figure 4B:
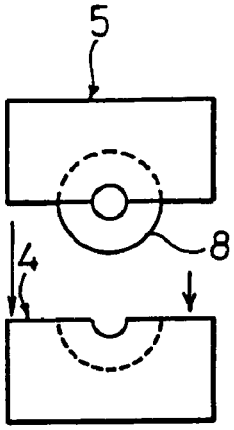
Figure 4C:
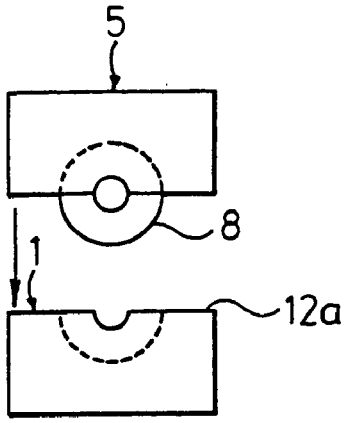
Figure 4D:
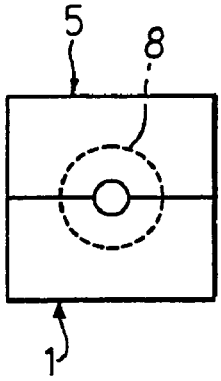
Figure 4E:
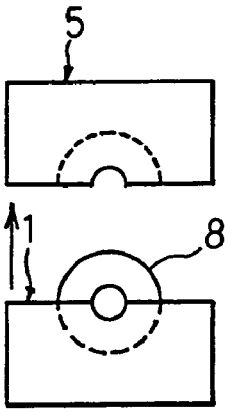
Figure 4F:
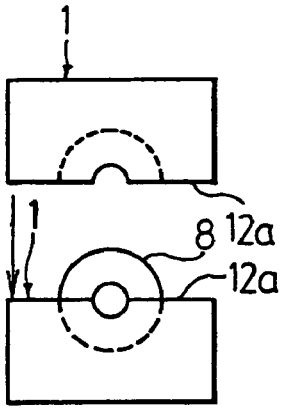
Figure 4G:
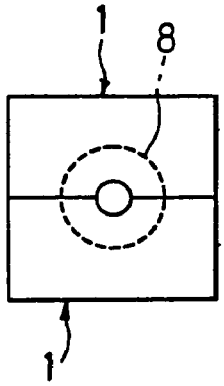

Transfer from the papermaking and dewatering step to the press drying step is carried out as shown in FIGS. 4A through 4G. To begin with, the undried fiber preform 8 is purged with compressed air fed through the suction holes 40 of the split mold piece 4 while being sucked through the suction holes 50 of the split mold piece 5 in the state shown in FIG. 4A, whereby the fiber preform 8 is released from the mold piece 4 on its half side while holding on to the mold piece 5 on the other half side as shown in FIG. 4B. As shown in FIG. 4C, the mold piece 5 still holding the fiber preform 8 is moved to the front of one of drying molds 1 used in the press drying step to make them face. Then, the parting faces of the two pieces are butted together to have the fiber preform 8 in as shown in FIG. 4D. As shown in FIG. 4E, the fiber preform 8 is attracted to the drying mold 1 by suction through the fluid passageways 15, while being purged with compressed air fed through the suction holes 50 of the piece 5 to be released from the piece 5. After the fiber preform 8 is attracted and put into the drying mold 1 by suction, the split mold piece 5 is withdrawn. As shown in FIG. 4F, another drying mold 1 mating with the drying mold 1 holding the half of the fiber preform 8 is moved, and the pair of the drying molds 1 and 1 are joined on their parting faces 12*a* and 12*a* to have the fiber preform 8 therebetween. An apparatus used to carry out this transfer operation will be described later in detail.

Figures 5A, 5B, 5C, 5D:
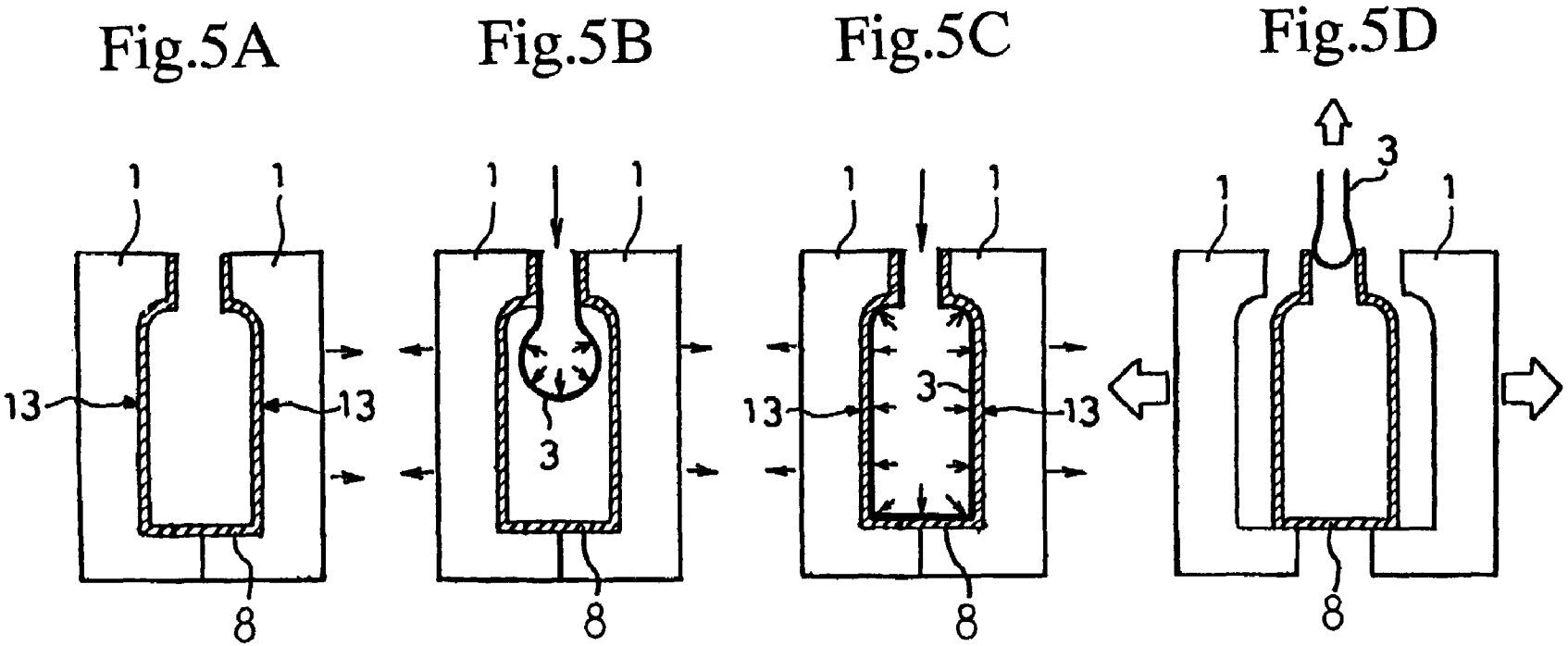

The press drying step is described by referring to FIGS. 5A to 5D. In FIGS. 5A to 5D, the structure, the shape and the like of the drying molds are schematically sketched for the sake of convenience. As shown in FIG. 5A, two drying molds 1 and 1 are butted on their parting faces to make a cavity of two drying parts 13, in which the undried fiber preform 8 is placed. The drying molds are previously heated to a prescribed temperature.

As shown in FIG. 5B, a hollow pressing member 3 of bag form is inserted into the fiber preform 8 while evacuating the inside of the drying molds 1 by suction from the outside through suction holes (not shown). The pressing member 3 can be of a material having the same characteristics as the material of the pressing member used in the papermaking step.

As shown in FIG. 5C, a pressurizing fluid is fed into the pressing member 3 to inflate it. The inflated pressing member 3 presses the undried fiber preform 8 to the inner wall of the drying part 13. The fiber preform 8 is thus pressed onto the inner side of the drying part 13 by the inflated pressing member 3. As a result, the water content of the fiber preform 8 is discharged outside in the form of steam through the passageways 15 without causing steam explosion. While drying of the fiber preform 8 proceeds in this manner, the configuration of the drying part 13, which includes the pattern of the passageways 15, is transferred to the exterior surface of the fiber preform 8. There is thus obtained a dried fiber preform, namely, a molded article having narrow ribs of desired width formed on the outer side of the body thereof. Since the fiber preform 8 is pressed from its inside toward the drying part 13 in this manner, the fiber preform 8 can be dried with high drying efficiency no matter how complicated the shape of the drying part 13 may be. Besides, the inner configuration of the drying part 13 can be transferred to the exterior surface of the fiber preform 8 (molded article) with accuracy. The pressurizing fluid which can be used to inflate the pressing member 3 includes compressed air (heated air), oil (heated oil) and other various liquids. The pressure for feeding the pressurizing fluid is preferably 0.01 to 5 MPa, particularly 0.1 to 3 MPa.

After the fiber preform 8 is dried sufficiently to a prescribed water content, the pressurizing fluid is withdrawn from the pressing member 3 to let the pressing member 3 shrink as shown in FIG. 5D. The shrunken pressing member 3 is taken out of the fiber preform 8, and the drying molds 1 and 1 are separated open to remove the dried fiber preform (molded article) 8.

According to the method of producing a molded article according to the present embodiment, a molded article having a plurality of narrow ribs on the outer surface of its body and having no depressions on the inner surface at the positions corresponding to the ribs can be manufactured in a stable manner and with good efficiency.

Figure 6:
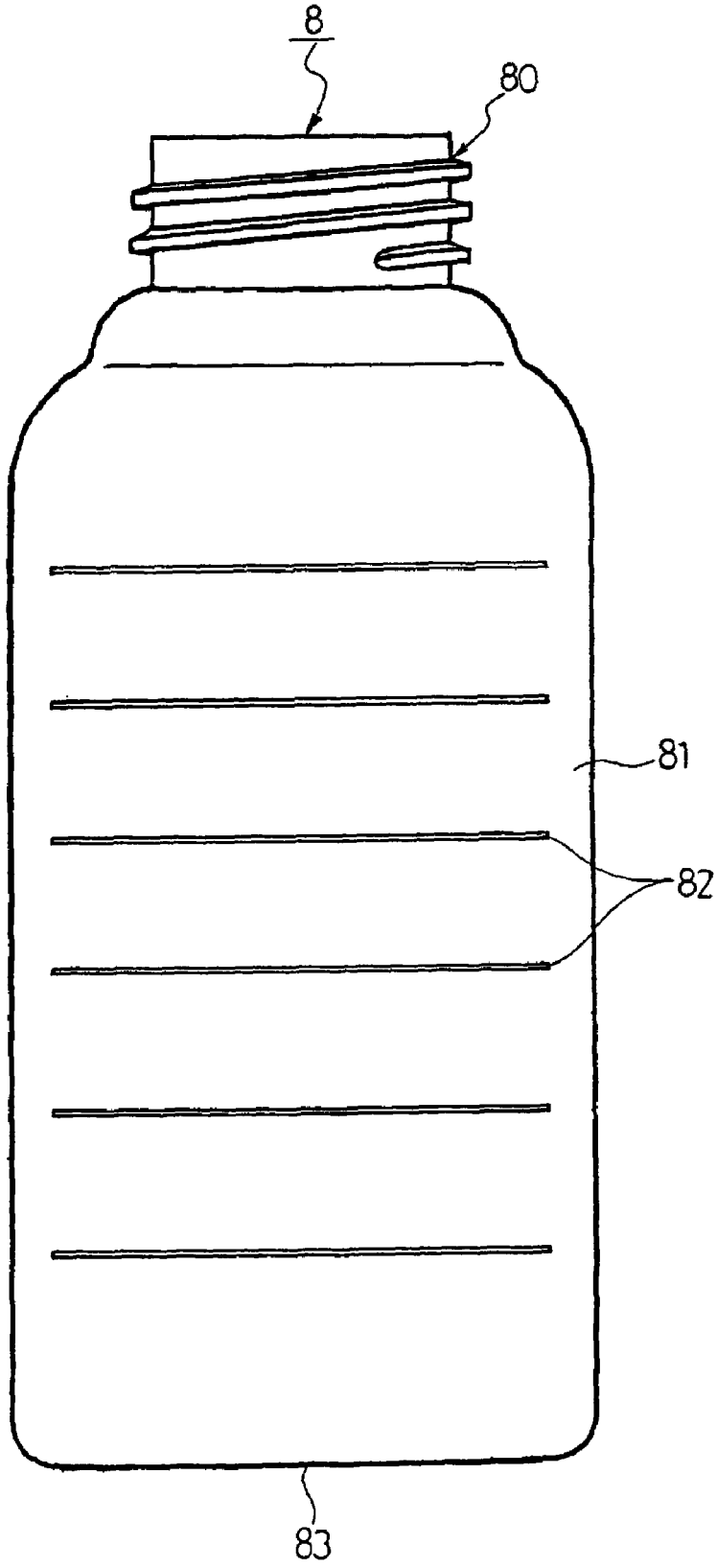
FIG. 6 is a front view of an example of the molded article according to the present invention.

FIG. 6 shows an example of the molded article according to the present invention, in which numeral 8 indicates a molded article.

As illustrated in FIG. 6, the molded article 8 is a cylindrical bottle the neck 80 of which has a smaller diameter than the body 81. The molded article 8 has a plurality of narrow ribs or ridges 82 formed on the outer surface of its body 81, the ribs extending horizontally around the periphery and being arrayed in the vertical direction at a prescribed interval. The ribs formed on the outer surface of the molded article of the present invention preferably have a height of 0.05 to 2 mm, particularly 0.1 to 1.0 mm, for providing a sure grip. Too high ribs are disadvantageous in that they may become an obstacle in coating the molded article 8, leaving some parts uncoated; a coating may gather at the feet of the ribs only to form an uneven coating layer; a coating penetrates easily; or the ribs break easily. The width of the ribs is preferably 0.05 to 5 mm, still preferably 0.1 to 2 mm. The interval of the ribs is preferably 3 to 50 mm, still preferably 5 to 25 mm, so as to improve a grip and secure molded article strength enough to be grasped.

The molded article 8 has no depressions on its inner side at the positions corresponding to the ribs 82. Therefore, when a coat is provided on the inner side of the molded article 8, coating can be carried out efficiently without involving penetration of a coating in depressions or without causing unevenness of coating. Further, the molded article 8's having no depressions leads to having increased impact strength, such as drop impact strength.

With high strength of the body 81 as reinforced by the ribs 82, the molded article 8 is convenient to use with excellent shape retention, hardly receiving a dent around its body 81 while in use. In case the molded article 8 is transported on a production line including, for example, an operation of filling with contents, and the molded article 8 is filled with contents and then capped while being held by a holding unit, such as a handler, the ribs 82 formed on the body 81 serve for nonslip to provide improved suitability for holding. Therefore, mishandling which badly affects the production line hardly occurs. Further, the molded article 8 has no seams in any of its neck 80, body 81 and bottom 83. The neck 80, body 81, and bottom 83 are integrally molded to provide an excellent apparatus. The molded article 8 can be produced by, for example, the above-described method of producing a molded article using the drying mold 1.

Figure 7:
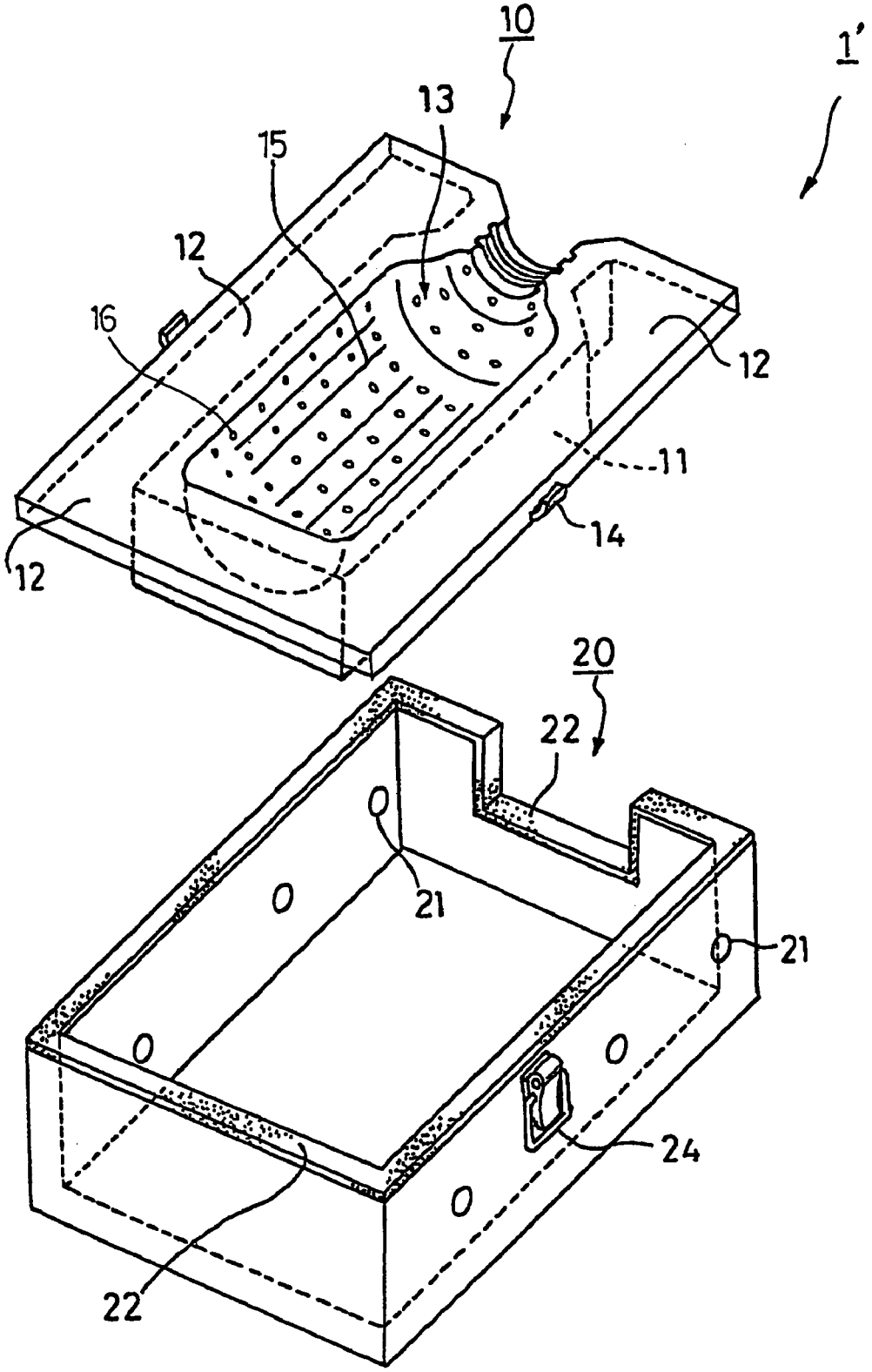
FIG. 7 is an exploded perspective of a drying mold according to a second embodiment of the present invention (corresponding to FIG. 1).
Figure 8A:
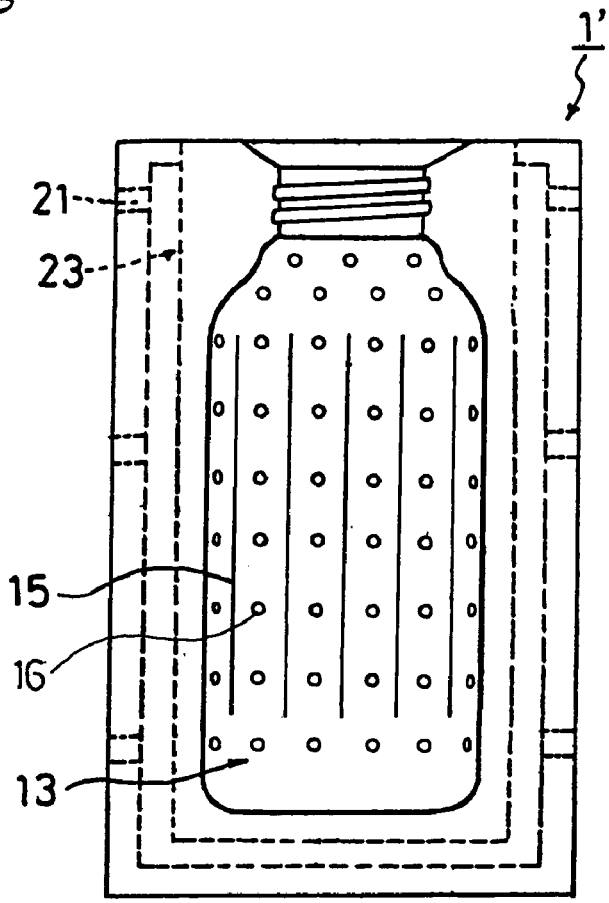
Figure 8B:
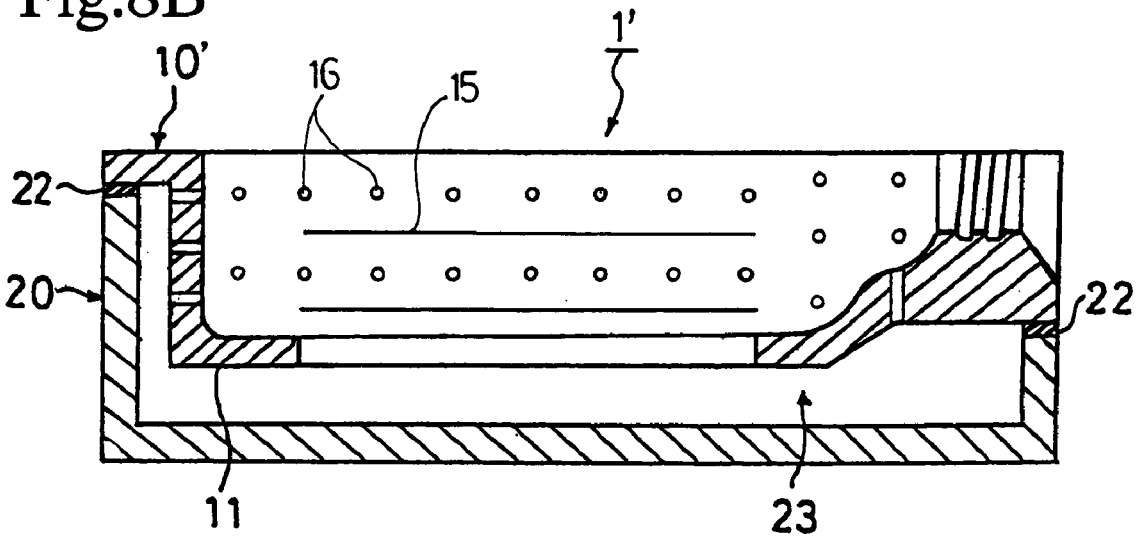

FIGS. 7, 8A, and 8B show a second embodiment of the drying mold according to the present invention. In these figures the same members as in the first embodiment are given the same numerals, and description therefor is omitted. Accordingly, the description about the first embodiment appropriately applies to the second one unless otherwise specified.

As shown in FIG. 7, the drying mold 1' according to the second embodiment has a plurality of fluid passageways 15 of slit form which extend vertically in the portion corresponding to the body of a molded article set in the concave drying part 13. A plurality of the passageways 15 are arrayed around the inner wall of the drying part 13 at a prescribed interval. More specifically, the passageways 15 interconnect the drying part 13 and the hollow chamber 23.

Figure 9:
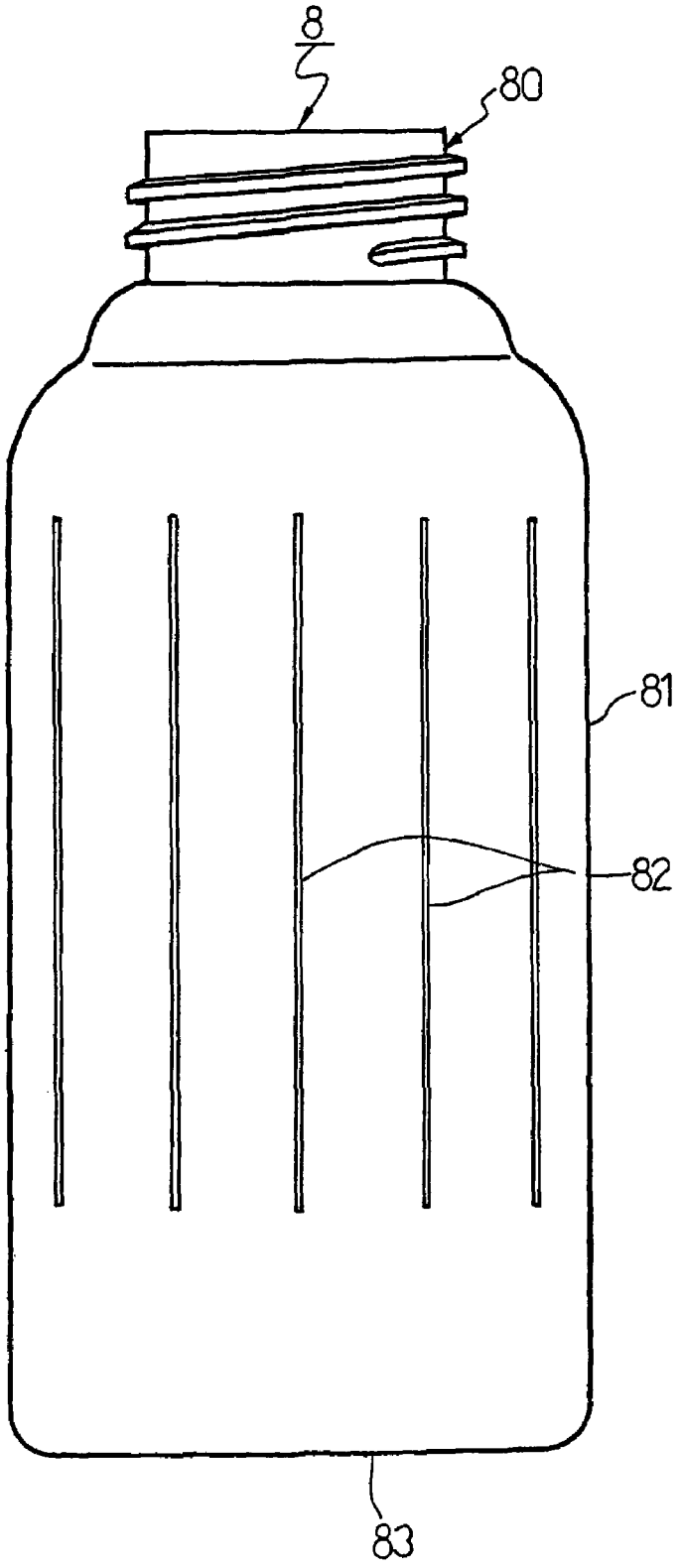
FIG. 9 is a front view of another example of the molded article according to the present invention.

Similarly to the drying mold 1 of the first embodiment, the drying mold 1' according to the present embodiment makes it possible to form narrow ridges of desired width on the outer surface of a molded article without involving steam explosion and without making depressions on the inner surface of the molded article in the positions corresponding to the ridges. Since either end of the passageways 15 do not reach the parting face, air escapes along the parting face can be suppressed when the fiber preform is transferred between the papermaking mold and the drying mold or when a molded article is removed from the drying mold by purging with compressed air and simultaneous suction through the passageways. Molded articles can thus be produced in a stable manner FIG. 9 depicts another example of the molded article according to the present invention. In FIG. 9 the same members as in the molded article 8 shown in FIG. 6 are given the same numerals, and description therefor is omitted. Accordingly, the description about that figure appropriately applies here unless otherwise specified. The molded article 8 has a plurality of narrow ribs 82 which extend vertically and are arrayed on the periphery of the body 81 at a prescribed interval. Similarly to the molded article 8 shown in FIG. 6, this molded article 8 has high shape retention and is unlikely to induce mishandling with a handling device. Having no depressions on the inner side in positions corresponding to the ribs 82, the molded article 8 can be coated efficiently. The molded article 8 can be produced by, for example, the above-described process of producing a molded article except for using the drying mold 1' of the second embodiment in place of the drying mold 1 of the first embodiment.

Figure 10:
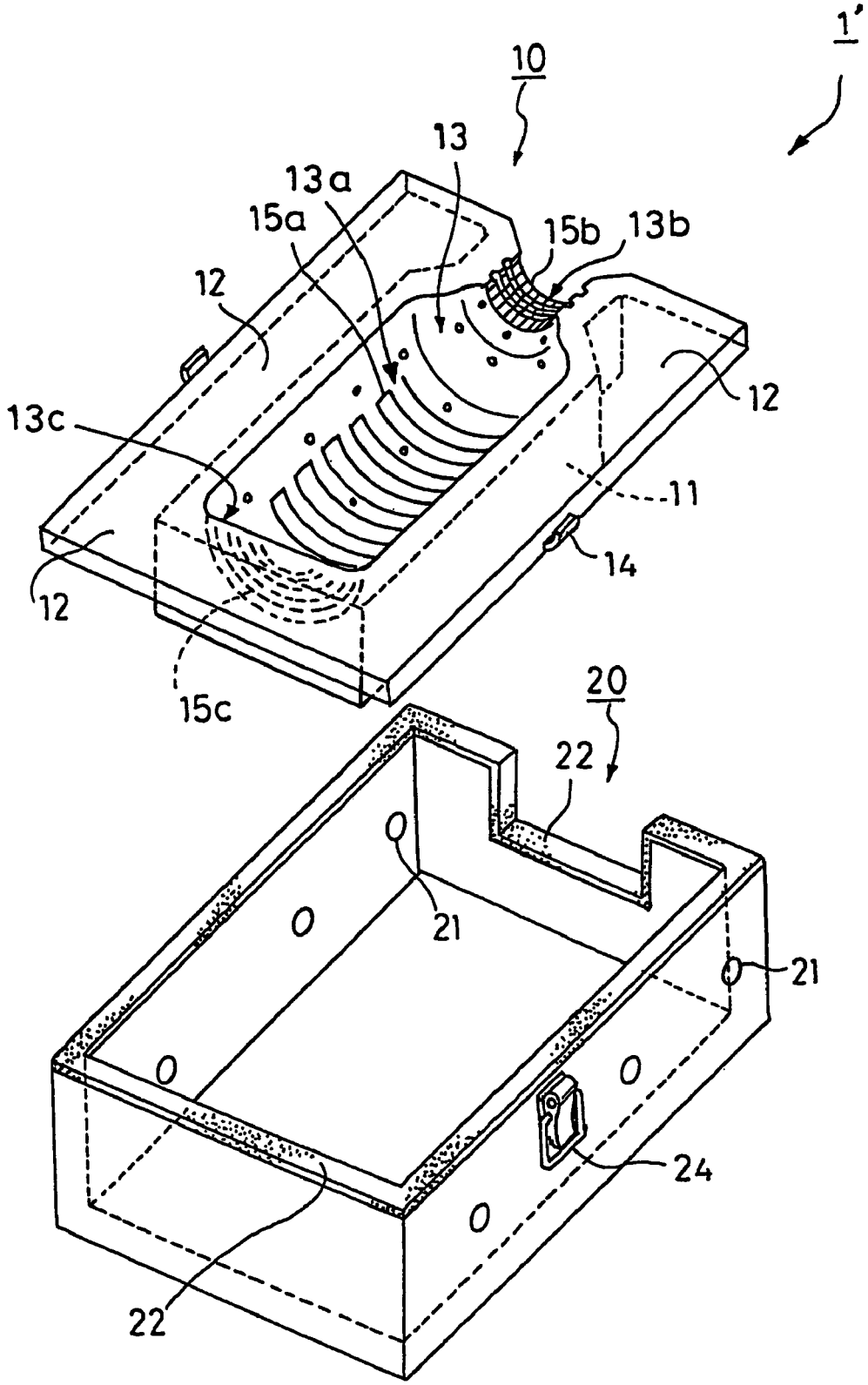
FIG. 10 is an exploded perspective of a drying mold according to a third embodiment of the present invention (corresponding to FIG. 1).
Figure 11:
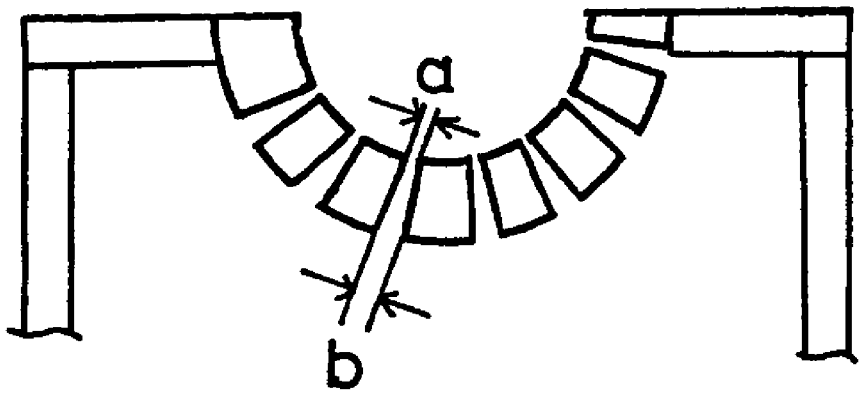
FIG. 11 schematically shows fluid passageways of slit form which are formed in a portion making a neck.

The present invention is not limited to the aforementioned embodiments. For example, while in the above embodiments the molded article 8 has ribs 82 formed around its body 81, ribs can be formed on the neck, a portion of the body where a label is to be stuck, and the bottom. In this case, a drying mold 1' according to the third embodiment shown in FIG. 10 is used, which has fluid passageways 15*a* in the portion 13*a* facing the body of a molded article where a label is to be stuck (hereinafter referred to as a label portion 13*a*), fluid passageways 15*b* in the portion 13*b* facing the neck of the molded article (hereinafter referred to as a neck portion 13*b*), and fluid passageways 15*c* in the portion 13*c* facing the bottom (hereinafter referred to as a bottom portion 13*c*). Where, in particular, ribs are formed on the neck, the ribs can be made use of for preventing cap's loosening. In the third embodiment, it is preferred that the passageways in any one of the portions (for example, the vertical passageways formed in the body portion as shown in FIG. 7 or the passageways formed in the neck portion as shown in FIG. 10) have slit widths a and b satisfying $\underline{a} \leqq \underline{b}$ as described previously. An example is shown in FIG. 11, in which the passageways 15*b* of the neck portion 13*b* have a slit width $\underline{a}$ smaller than a slit width $\underline{b}$.

The passageways 15*a* are a continuous slit which winds with square turns. The passageways 15*b* are formed vertically along the height direction of the drying mold 1' in the radial direction around the whole inner surface of the neck portion 13*b*. The passageways 15*c* are formed on the bottom portion 13*c* to make concentric arches. The passageways 15*b* formed in the neck portion 13*b* may be formed not only vertically as shown in FIG. 10 but also laterally. In producing a molded article 8 having a threaded neck 80 as shown in FIG. 9, the passageways 15*b* may be formed along the thread.

Figure 12:
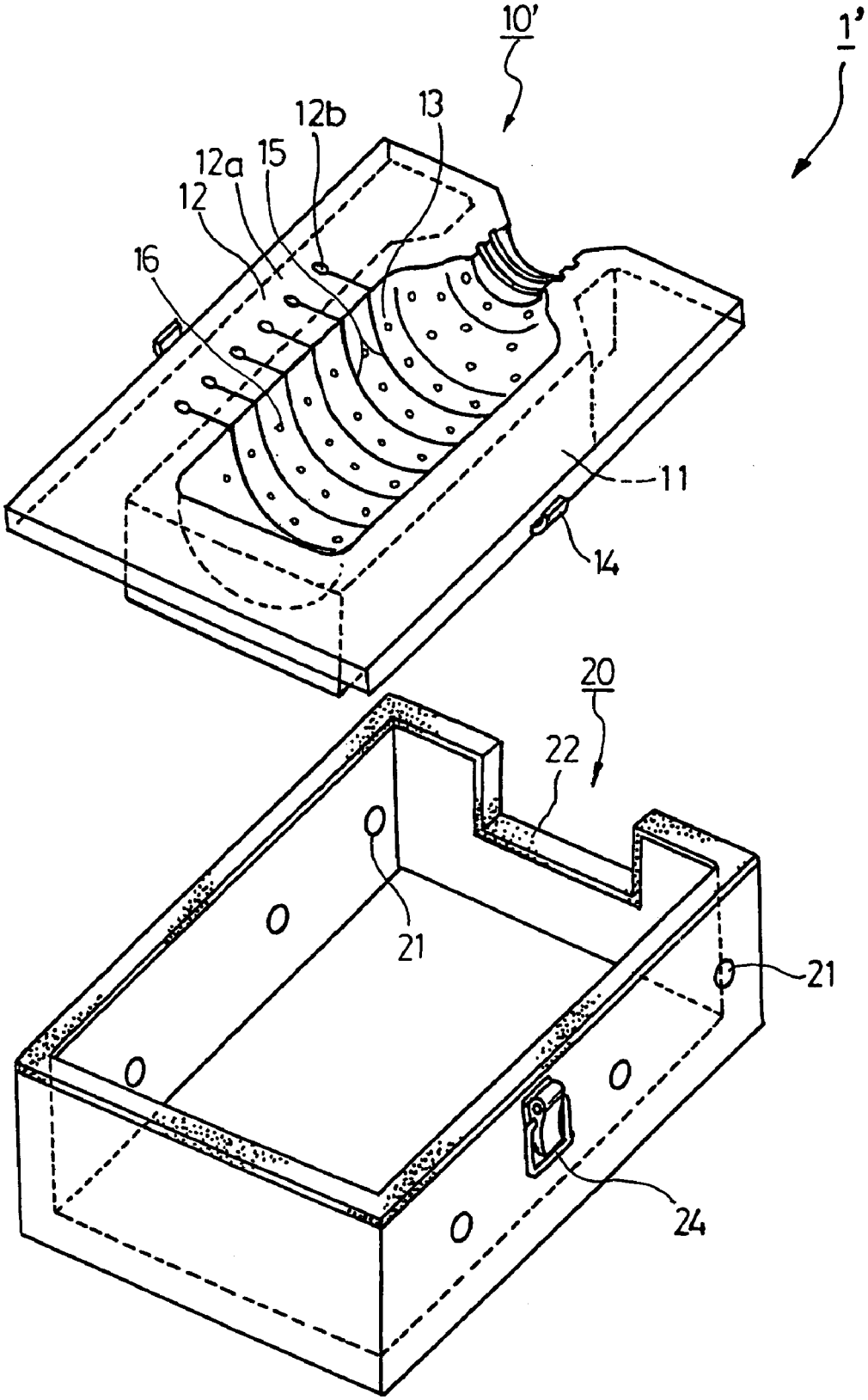
FIG. 12 is an exploded perspective of a drying mold according to a fourth embodiment of the present invention (corresponding to FIG. 1).
Figure 13A:
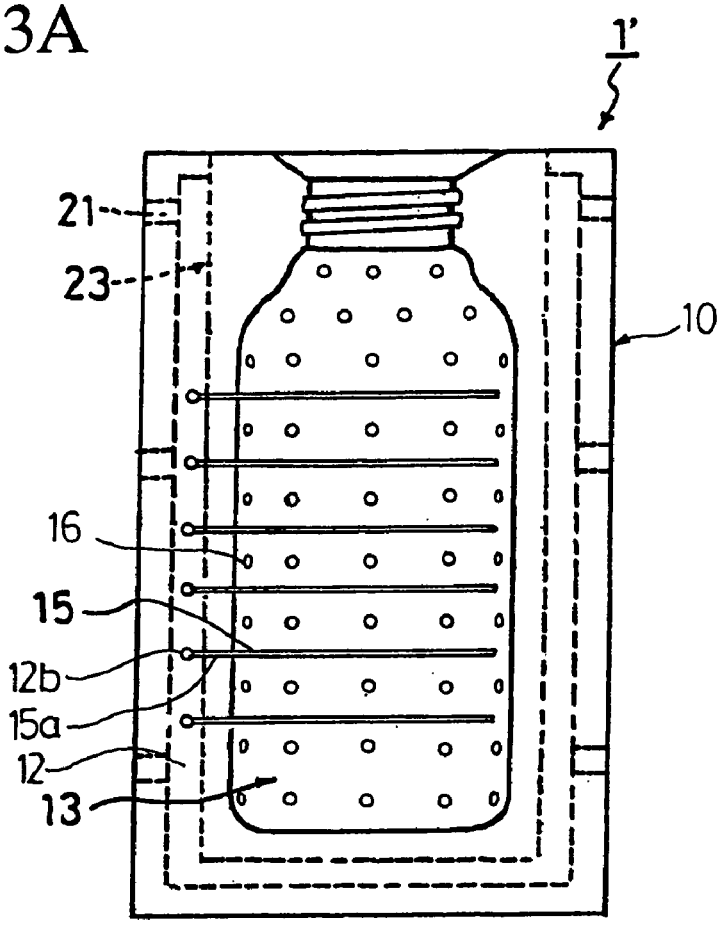
Figure 13B:
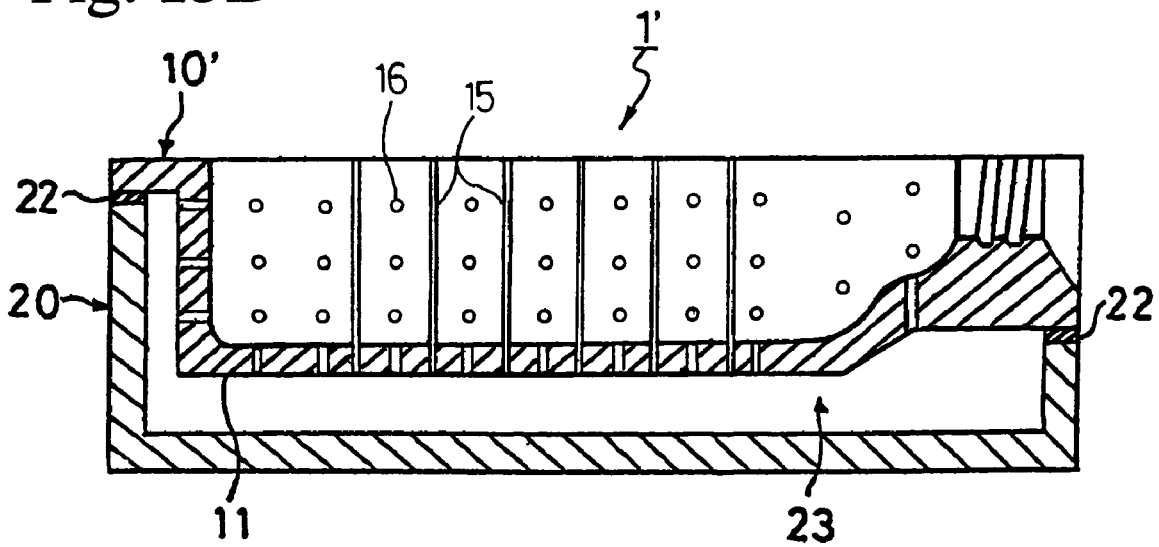
Figure 14:
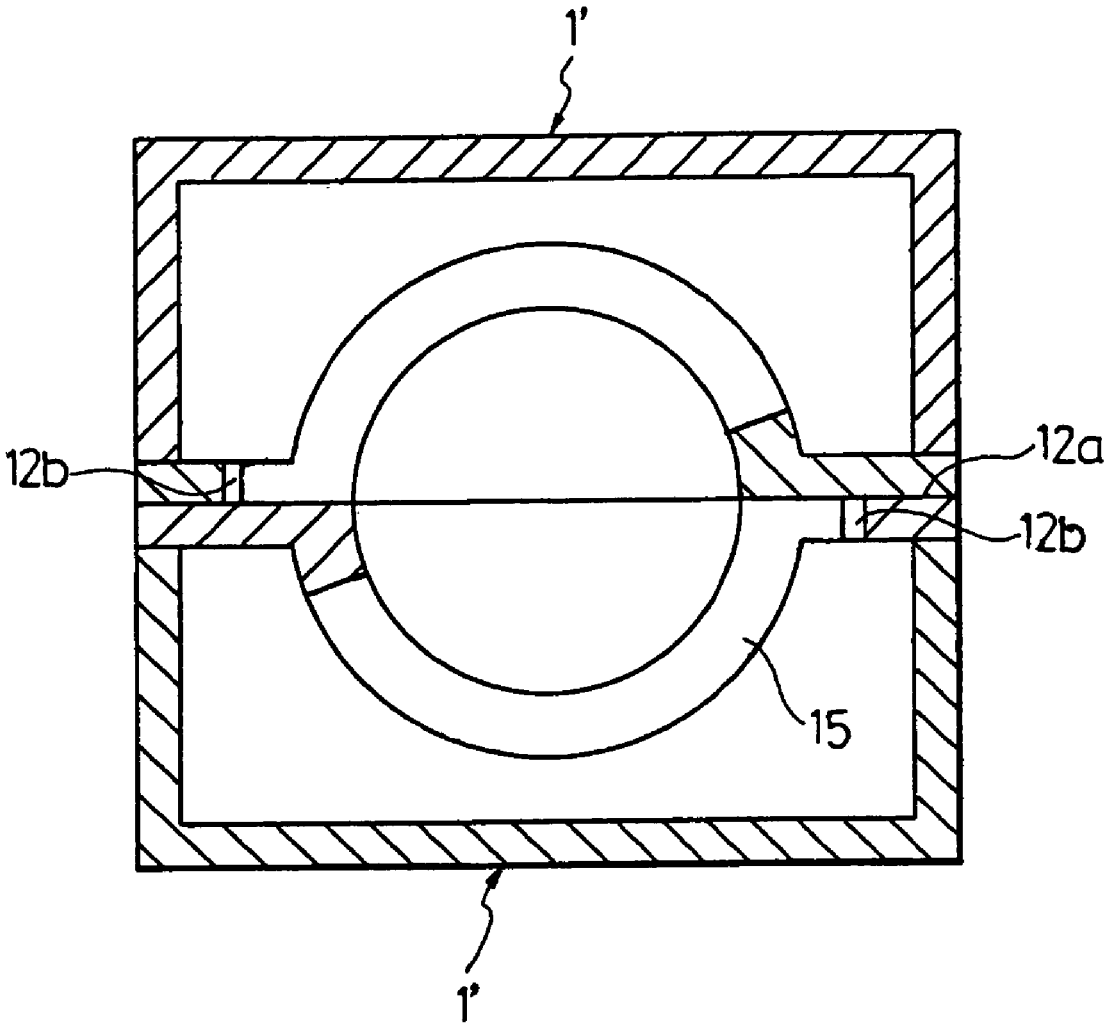
FIG. 14 is a schematic cross-section of a pair of the drying molds of the fourth embodiment joined together.

While it is preferred in the present invention that either end of a slit as an fluid passageway does not reach the parting face of the drying mold as in the foregoing embodiments, it may take the configuration of a drying mold 1' according to a fourth embodiment shown in FIGS. 12, 13A, and 13B. That is, one end each of the slits as passageways 15 reaches the parting face 12*a* of the drying mold 1'. Every passageway 15 connects to a through-hole 12*b* which pierces the flange 12 and is open to the parting face 12*a*. When the drying mold 1' according to this embodiment is mated with another half in the production of a molded article, the two halves are mated in such a manner that the open ends of their passageways 15 do not face each other as depicted in FIG. 14 (in which both mold pieces are drying molds, one of which is replaced with a papermaking mold piece in transfer of a wet fiber preform). By this configuration, air escapes along the parting face 12*a* can be suppressed when the fiber preform is transferred between the papermaking mold and the drying mold or when a molded article is removed from the drying mold by purging with compressed air simultaneously with suction through the passageways. Molded articles with ribs reaching near the parting face 12*a* can thus be produced in a stable manner. Further, the passageways 15 have a longer length in the drying part 13, the drying efficiency is increased to produce the molded article more efficiently.

While the drying molds according to the foregoing embodiments are of the type which are used as a pair mated together, they can be used as a one-piece drying mold, or three or more of them are used in combination.

While the drying part of the drying molds according to the foregoing embodiments is a concavity, it may be a convexity in conformity with the contour of an article to be molded.

The drying mold of the foregoing embodiments can be heated with a plate member equipped with a heating means, e.g., an electric heater, which is fitted to the backside of the drying mold, i.e., the side opposite to the drying part. In this case, the heat generated in the plate member is indirectly applied to the fiber preform through the manifold member 20 and the fiber preform holding member 10. Compared with a heating means fitted to the fiber preform holding member 10 that is in direct contact with the fiber preform, unevenness of temperature hardly occurs, and the fiber preform can be dried more uniformly. The heat capacity of the fiber preform holding member 10 can be increased sufficiently, which further prevents temperature unevenness. This is particularly advantageous in that a temperature drop of the drying mold is suppressed even in continuous large-volume production of fiber preforms. When the temperature of the drying mold is set at, for example, 200° C., a temperature drop which occurs immediately after putting a fiber preform therein is preferably within 20° C., particularly within 10° C.

The present invention is especially suited to a method of producing a pulp slurry including the step of papermaking in which a pair of split mold pieces are joined to make a papermaking mold, and a pulp slurry is charged into the cavity of the papermaking mold. The present invention is applicable to other production methods, for example, a method comprising immersing a papermaking mold in a container filled with a pulp slurry to feed the pulp slurry into the cavity of the papermaking mold. It is also applicable to a production method in which a papermaking mold having fluid passageways like a split mold piece is placed with its papermaking surface up, and an outer frame surrounding at least the papermaking surface is set up on the papermaking mold with liquid tightness to form a pool, in which a prescribed amount of a pulp slurry is poured and sucked through the passageways to build a molded article on the papermaking surface.

Apparatus which can be used to carry out the transfer of a fiber preform described with reference to FIGS. 4A to 4G are now described. FIGS. 15 through 22 are schematic views of the method of producing a molded article and preferred apparatus used therefor, viewed from above.

As shown in FIGS. 15 to 20, a production apparatus 100 has a first mold 110 composed of a pair of split mold pieces (hereinafter, halves) A and B, which is a papermaking mold, and a second mold 120 composed of a pair of split mold pieces (hereinafter, halves) C and D, which is a drying mold. The halves A and B correspond to the two halves 4 and 5 previously described. The halves C and D correspond to the above-described drying molds 1 and 1. The first mold 110 is closed with the parting faces of the halves A and B facing each other to form a cavity corresponding to the contour of an article to be molded. The same applying to the second mold 120, the halves C and D are closed to form the same cavity. The halves C and D of the second mold are equipped with a heating means such as a heater so as to be heated to a prescribed temperature. The halves A and C have the same cavity configuration, and the halves B and D have the same cavity configuration. With the halves A and B of the first mold 110 and the halves C and D of the second mold 120 closed, openings 111 and 121 connecting to the respective cavities are formed on the top of the molds 110 and 120, respectively.

In the apparatus 100 at least the halves A, C, and D should have a molded article holding means. In producing pulp molded articles, all the halves A to D have a molded article holding means which also functions as a dewatering means. The holding means comprises interconnecting holes and a suction means.

The halves A and C, one of the halves making each of the molds 110 and 120, are fixed to the same side of a slide platen 130. The halves A and C are fixed to the slide platen 130 on their backs so that their height directions may be in parallel with the height direction of the slide platen 130. The slide platen 130 is fixed to the inner side of a first side plate 131 on its back, i.e., the side opposite to the side having the halves A and C fixed thereto, via a sliding means such as bearings so that it can slide reciprocally in the halves A's and C's width direction.

The other halves B and D of the two molds 110 and 120 are separately fixed on the same side of two movable platens 132 and 133. The halves B and D are fixed to the respective movable platens 132 and 133 on their back. The distance between the halves B and D is the same as that between the halves A and C fixed to the slide platen 130. Thus, the parting face of the half A faces the parting face of the half B. Similarly, the parting face of the half C faces the parting face of the half D. The movable platens 132 and 133 are supported by the respective pairs of tie bars 134 and 135. Both ends of each pair of tie bars 134 and 135 are fixed to the first side plate 131 and a second side plate 138 standing face to face with the first side plate 131.

The second side plate 138 has hydraulic cylinders 136 and 137 attached to the outer side thereof. The tips of piston rods 136' and 137' from the respective hydraulic cylinders 136 and 137 are fixed to the side of the respective movable platens 132 and 133 opposite to the side having the halves B or D fixed. The hydraulic cylinders 136 and 137 operate to move the movable platens 132 and 133 along the tie bars 134 and 135, whereby the halves B and D reciprocally move in the direction perpendicular to the parting faces of the halves A and C fixed to the slide platen 130. The apparatus 100 so constructed, the halves A and B of the first mold 110 can be opened or closed, and the halves C and D of the second mold 120 can be opened and closed similarly.

In the apparatus 100, the slide platen 130 moves to bring the half A of the first mold 110 fixed to the slide platen 130 to the front of the half D of the second mold 120 fixed to the movable platen, so that these facing halves can be closed or opened. Through these movements a fiber preform is handed over from the first mold to the second mold while being held on the half.

Figure 15:
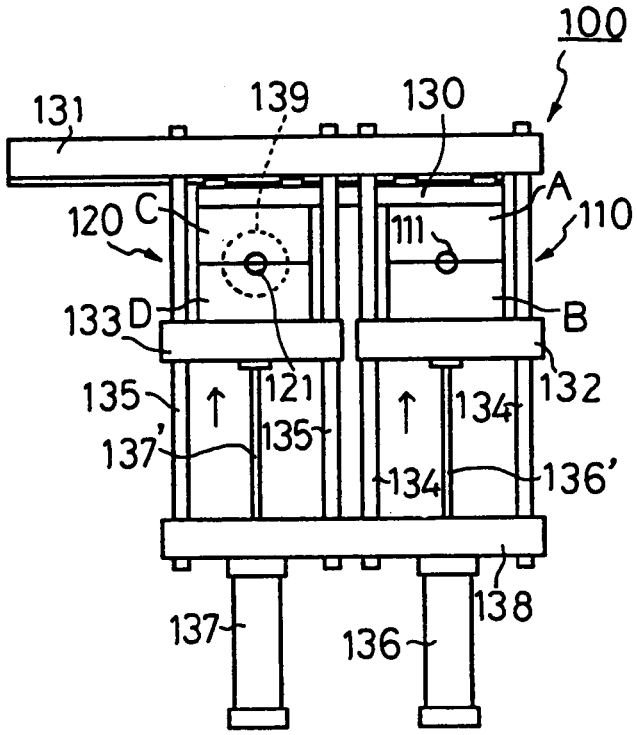
FIG. 15 is a schematic plan of an apparatus which is preferably used to carry out the method of producing a molded article.

The method of producing a molded article by the use of the apparatus 100 having the above-described construction will be described in conjunction with the movements of the apparatus 100. As shown in FIG. 15 to begin with, the slide platen 130 is moved by a prescribed means to the position shown. The hydraulic cylinders 136 and 137 operate to push the halves B and D to close the half A with the half B, and the half C with the half D. At the start of operation, either the first mold 110 or the second mold 120 is not loaded. While the apparatus 100 is in operation, the first mold 110 is not loaded, but the second mold 120 contains a fiber preform 139 having a high water content that has been molded in the first mold 110. For the sake of convenience, the following description is for the apparatus 100 being in operation.

A pulp slurry feed pipe (not shown) comes down from above the first mold 110 and connects at its tip to the opening 111. In this stage an injection pump (not shown) operates to inject a pulp slurry from a pulp slurry source (not shown) into the cavity of the first mold 110. Simultaneously with the injection, the cavity is evacuated by suction from the outside through the interconnecting holes of the halves A and B. The water content of the pulp slurry is sucked up, and pulp fibers are accumulated on the inner wall of the cavity. After a prescribed amount of the pulp slurry is charged, the pulp slurry feed is stopped, and the cavity is sucked for dewatering. As a result, pulp fibers are accumulated on the inner wall of the cavity of the first mold 110 to form a water-containing fiber preform. Having a high water content, the fiber preform thus molded is very difficult to take out of the cavity with an external handling device and transfer to a subsequent step (a fabrication step). Because the present invention makes it feasible to transfer the fiber preform from the first mold 110 to the second mold 120 while keeping the fiber preform in the half, the fiber preform having such poor handling properties can be fabricated easily.

While a fiber preform is being formed in the first mold 110, fabrication of the fiber preform 139 put in the second mold 120 is carried out. The fabrication in this particular embodiment is dehydration under heat and pressure (hereinafter, heat/pressure dehydration). The heat/pressure dehydration, being exactly as described previously, is not described again here.

On completion of fiber preform formation in the first mold 110 and heat/pressure dehydration of the fiber preform in the second mold 120, the pulp slurry feed pipe (not shown) lifts to separate from the first mold 110. At the same time the pressing member used for the heat/pressure dehydration is taken out of the cavity of the second mold 120.

Figure 16:
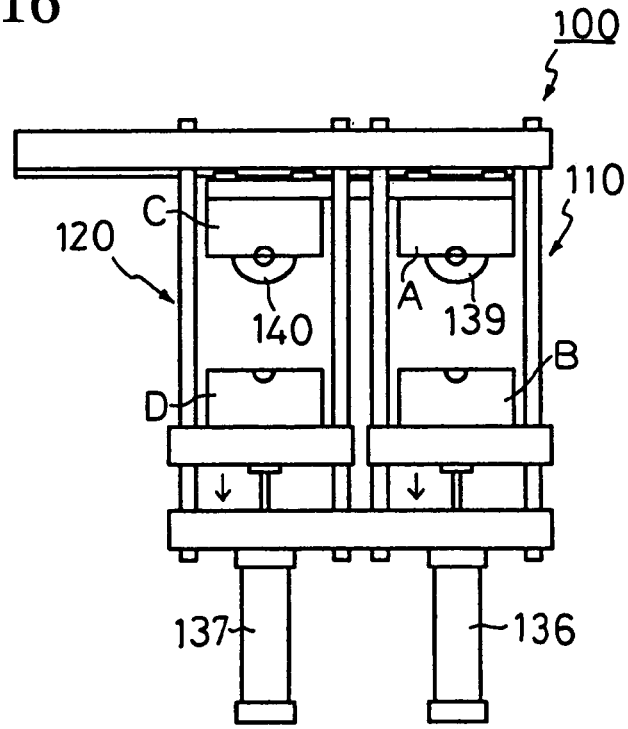
FIG. 16 schematically illustrates the state of the apparatus of FIG. 15 in which a first mold and a second mold are open.

Then, among the two halves of the first mold 110, only the half A is sucked to hold the fiber preform therein. At the same time, among the two halves of the second mold 120, only the half C is sucked to hold therein the molded article obtained by the pressure/heat dehydration. In this state, the hydraulic cylinders 136 and 137 operate to pull the halves B and D backward thereby parting the halves A and B and the halves C and D as shown in FIG. 16. As a result, the fiber preform 139 having been molded in the first mold 110 is held on to the half A by its vertical half, and the molded article 140 having been obtained by heat/pressure dehydration in the second mold 120 is held on to the half C by its vertical half as depicted in FIG. 16.

Figure 17:
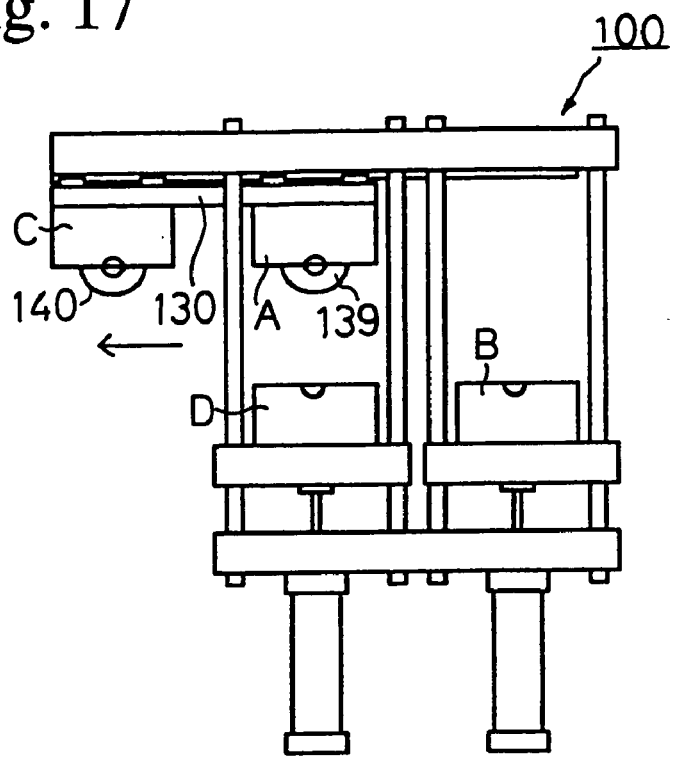
FIG. 17 schematically illustrates the apparatus of FIG. 15 in which the half A of the first mold faces the half D of the second mold.

The slide platen 130 moves in the direction indicated by the arrow in FIG. 17 while keeping the fiber preform 139 and the molded article 140 in the halves A and C, respectively, to bring the half A to the position where the half C has been before the movement. Thus, the parting face of the half A and that of the half D of the second mold 120 face to each other. As a result of this movement of the slide platen 130, the half C holding the molded article 140 obtained by the heat/pressure dehydration is sent to a line of the next step (e.g., the step of ejecting a product).

Figure 18:
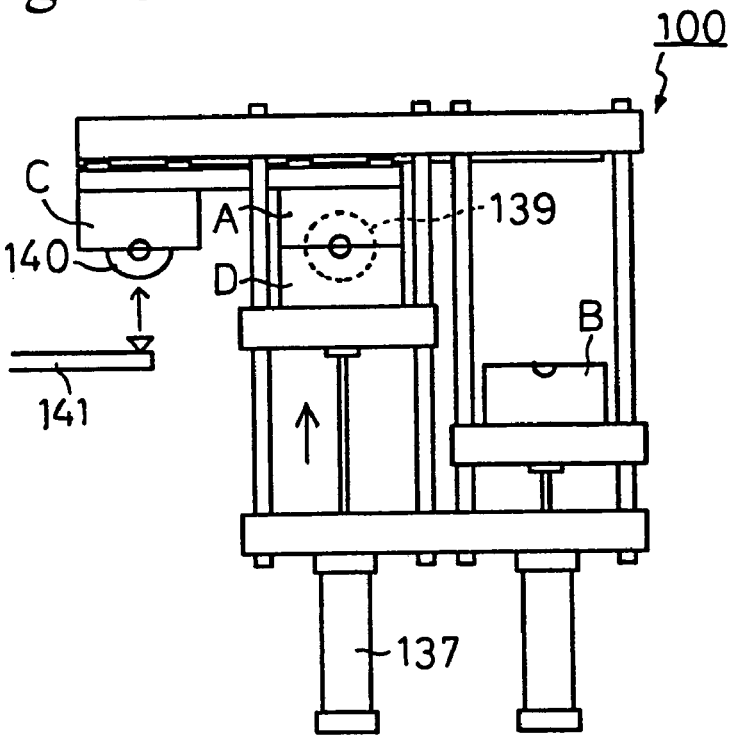
FIG. 18 schematically illustrates the apparatus of FIG. 15 in which the half A of the first mold and the half D of the second mold join.

With the half A of the first mold 110 and the half D of the second mold 120 facing each other, the hydraulic cylinder 137 operates to push the half D forward to close the half A with the half D with the fiber preform 139 therebetween as shown in FIG. 18. In this closed state, suction in the half A is stopped to relax the fiber preform 139 and, concurrently, the half D is sucked to hold the fiber preform 139 therein. In the meantime, an arm 141 for product receiving approaches the molded article 140 held in the half C that has moved to the next line. The arm 141 is equipped with a suction means.

Figure 19:
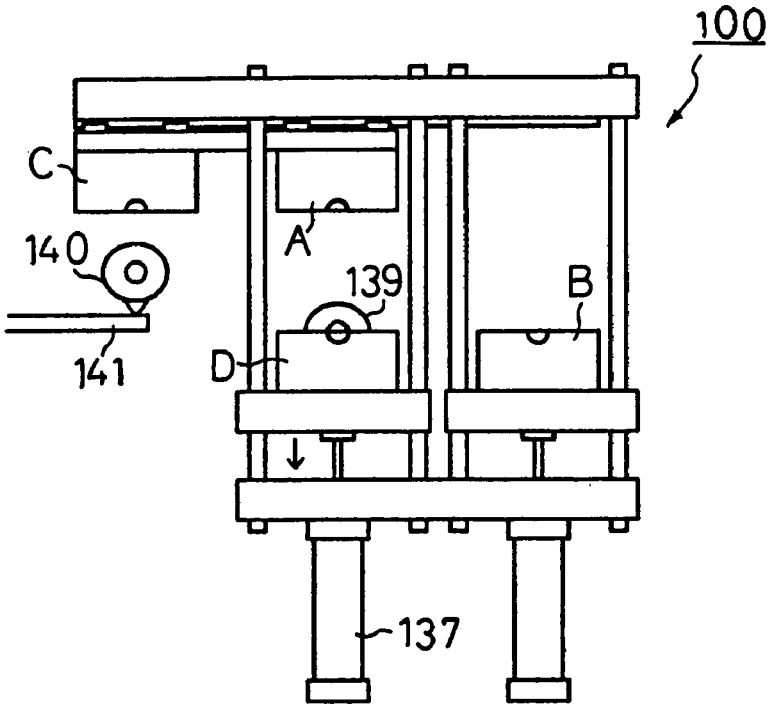
FIG. 19 schematically illustrates the apparatus of FIG. 15 in which a fiber preform has been transferred from the half A of the first mold to the half D of the second mold.

The hydraulic cylinder 137 then operates to pull back the half D to part the half D from the half A. As mentioned above, since the half A no longer holds the fiber preform 139, but the half D does, this mold opening results in transfer of the fiber preform 139 to the half D. In this way, transfer of the fiber preform 139 from the half A to the half D completes. Meanwhile, the suction part of the product receiving arm 141 comes into contact with the molded article 140 held in the half C and exerts suction on the molded article 140 to hold it as shown in FIG. 19. At the same time, the suction of the half C stops to release the hold of the molded article 140. The product receiving arm 141 separates from the half C to remove the molded article 140 from the half C and sends it to the next step.

Figure 20:
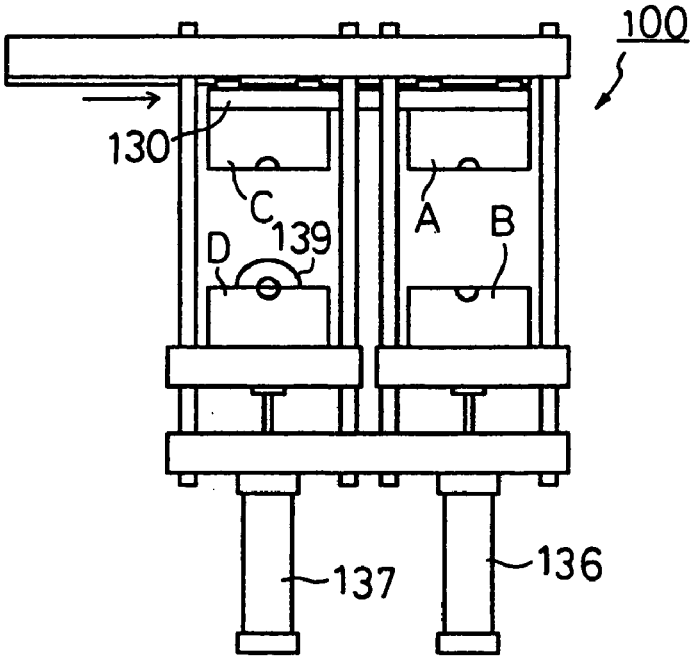
FIG. 20 schematically illustrates the apparatus of FIG. 15 in the stage before the first and the second molds are closed.

On completion of the transfer, the slide platen 130 returns to the position before the movement as shown in FIG. 20, whereby the half A which has released the fiber preform 139 returns to the position before the movement and faces the half B, and the half C which has released the hold of the molded article 140 returns to the position before the movement and faces the half D now holding the fiber preform 139. Then, the hydraulic cylinders 136 and 137 operate to push the halves B and D forward. As a result, the half A is closed with the half B, and the half C is closed with the half D with the fiber preform 139 therebetween. Thus, the state shown in FIG. 15 is restored. The above-described operations are repeated thereafter.

According to this embodiment, because any mechanical deforming force is not imposed on the fiber preform, the fiber preform undergoes no undesired deformation, and there is no fear of misregistration of the fiber preform in a mold that is liable to occur in handling with an external handling device. Compared with apparatus using an external handling device, the apparatus of the present embodiment has a smaller daylight between the halves during the transfer of the fiber preform or the molded article, which makes size reduction feasible, and involves a reduced number of steps, which leads to a reduction of production cycle.

Figure 21A:
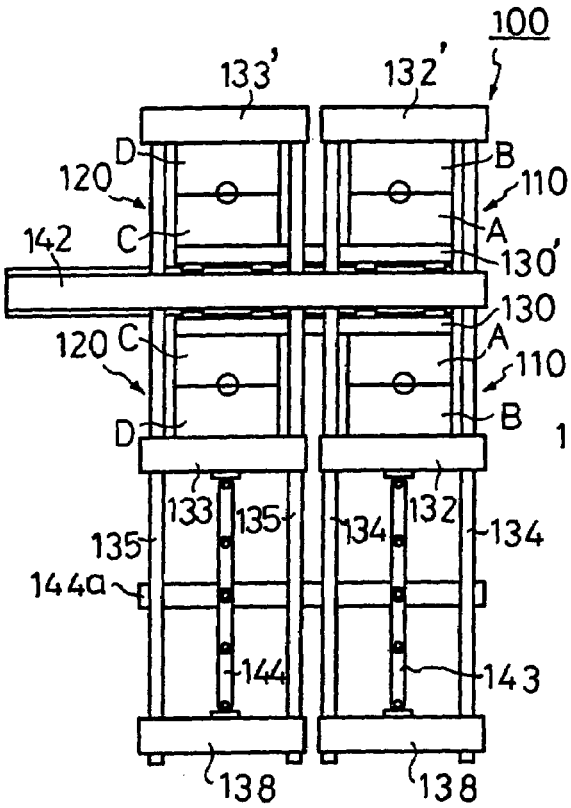
FIGS. 21A and 21B are schematic views of another apparatus of production seen from above, in which FIG. 21A corresponds to FIG. 15, and FIG. 21B corresponds to FIG. 16.
Figure 21B:
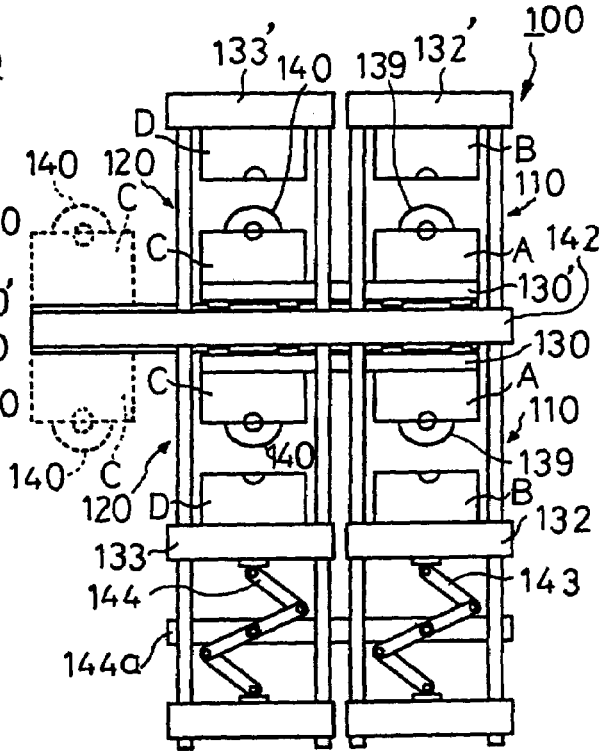
Figure 22:
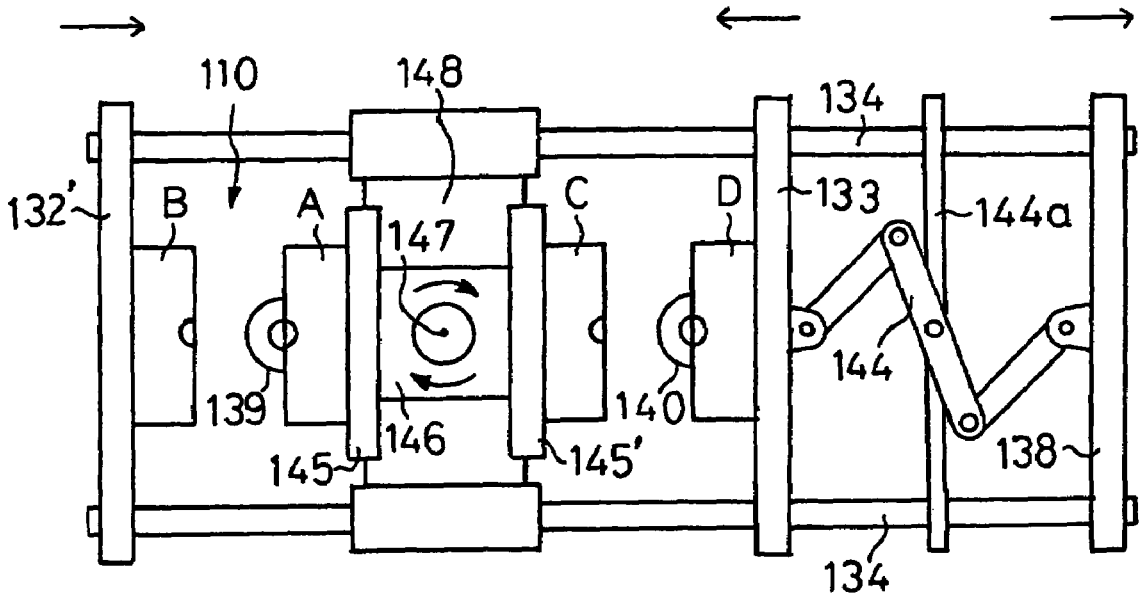
FIG. 22 is a schematic view of still another apparatus of production seen from above (corresponding to FIG. 16).

Other embodiments of the apparatus are described by referring to FIGS. 21A, 21B, and 22 only with reference to different points from the aforementioned embodiment. The description about the foregoing embodiment appropriately applies unless otherwise specified. In FIGS. 21A, 21B, and 22, the same members as in FIGS. 15 to 20 are given the same numerals.

The apparatus 100 according to the embodiment shown in FIGS. 21A and 21B is a tandem type molding machine. FIGS. 21A and 21B are equivalent to FIGS. 15 and 16, respectively, of the foregoing embodiment. The state indicated in dotted line in FIG. 21B is equivalent to the state of FIG. 17. The production apparatus 100 according to this embodiment has two first molds 110 and two second molds 120. It is capable of molding and fabricating (drying under heat and pressure) two fiber preforms in a single cycle. In the apparatus 100 according to the present embodiment, slide platens 130 and 130' slide to bring the two halves A fixed thereto face to face with the two halves D fixed to the movable platens 133 and 133', while the movable platens 133 and 133' move reciprocally with reference to the slide platens 130 and 130' to close and open the molds, whereby fiber preforms can be transferred from the first molds to the second molds while being held in the half.

The present embodiment is the same as the foregoing embodiment in that a half A of a first mold 110 and a half C of a second mold 120 are fixed to a slide platen. In the present embodiment, two slide platens are used. One of the two halves A and one of the two halves C are fixed to one of the slide platens (the slide platen 130), while the other half A and the other half C are fixed to the other slide platen 130'. The two halves A are fixed back to back to the respective slide platens 130 and 130'. The two halves C are fixed similarly. Both the slide platens 130 and 130' are fixed to a fixed plate 142 via respective sliding means, such as bearings, and reciprocally slide in the direction of the width of the halves A and C.

The halves B and B of the first molds 110 are fixed to movable platens 132 and 132', respectively. Similarly, the halves D and D of the second molds 120 are fixed to movable platens 133 and 133', respectively. To the side of the movable platens 132 and 133 opposite to the side having the halves B and D fixed thereto, one end each of link mechanisms 143 and 144 are fixed, respectively. The other end of the link mechanisms 143 and 144 are fixed to the respective second side plates 138, 138'. The link mechanisms 143 and 144 are secured to a support member 144*a* at their support. The movable platen 132 and the fixed plate 142 are supported by a pair of tie bars 134. Similarly, the movable platen 133 is supported by a pair of tie bars 135. The fixed plate 142 is also supported by the tie bars 135. Both ends of each pair of tie bars 134 and 135 are fixed to the respective movable platens 132' and 133' and the respective second side plates 138 and 138'. Thus, the movable platens 132, 132', 133, and 133' are reciprocally movable along the tie bars 134 and 135. The fixed plate 142 and the support member 144*a* for the link mechanisms 143 and 144 are in a fixed state.

Closure and opening of the molds of the production apparatus 100 according to the present embodiment are carried out as described below. The link mechanisms 143 and 144 are extended from their contracted state by a prescribed means to bring the half B and the half D fixed to the movable platens 132 and 133, respectively, closer to the half A and the half C fixed to the slide platen 130 and finally close the molds. Concurrently, the movable platens 132' and 133', which operate synchronously with the operation of the link mechanisms 143 and 144, move toward the slide platen 130' to bring the halves B and D fixed thereto closer to the halves A and C fixed to the slide platen 130' and finally close the molds. The second side plates 138 and 138', to which one end of the link mechanisms 143 and 144 are fixed, move together with the contraction and expansion of the link mechanisms 143 and 144. Movements for mold opening are the reverse.

The apparatus 100 shown in FIG. 22 is equivalent to FIG. 16 of the aforementioned embodiment. In the production apparatus 100 according to this embodiment, the half A of the first mold 110 and the half C of the second mold 120 are fixed back to back to the respective revolving platens. In detail, the half A is fixed to a revolving platen 145, and the half C is fixed to a revolving platen 145'. The sides of the revolving platens 145 and 145' opposite to their sides having the halves are fixed to the opposite sides of a prism rotator 146, respectively. The rotator 146 has a rotating shaft 147 in the height direction of the halves A and C and stands on a base plate 148. It is capable of rotating on the shaft in either direction.

The half B of the first mold 110 is fixed to the movable platen 133', and the half D of the second mold 120 is fixed to the movable platen 133. The movable platens 133 and 133' are arranged face to face in parallel with the rotator 146, to which the revolving platens 145 and 145' are fixed, interposed therebetween. Thus the halves A and C face to the halves B and D, respectively, and are to be closed or opened. One end of a link mechanism 144 is fixed to the side of the movable platen 133 opposite to the side having the half D, with the other end being fixed to the second side plate 138. The movable platen 133 and the base plate 148 are supported by a pair of tie bars 134. Both ends of the pair of tie bars 134 are fixed to the movable platens 133' and the second side plate 138. The base plate 148 and the support member 144*a* for the link mechanism 144 are fixed members. Thus, the halves D and B fixed to the movable platens 133 and 133' are reciprocally movable along the tie bars 134 in the direction perpendicular to the direction of the rotating shaft. In this embodiment, unlike the foregoing embodiments, a molded article 140 obtained by fabrication (heat/pressure dehydration) in the second mold 120 is held in the half D when the second mold 120 is opened.

The production apparatus 100 of the present embodiment is required to have a molded article holding means, such as a suction means, in at least the halves A and D. In the production of pulp molded articles, for example, all the halves A to D have such a holding means as in the embodiments shown in FIGS. 15 through 21A and 21B, which depends on the article to be molded.

Transfer of a fiber preform from the first mold to the second mold in the production apparatus 100 according to the present embodiment is carried out by the revolution of the revolving platens 145 and 145'. The rotator 146 having the revolving platen 145 fixed thereto rotates from the state shown in FIG. 22 by 180° whereby the half A fixed to the revolving platen 145 turns around and faces the half D fixed to the movable platen 133. The link mechanism 144 then operates to bring the half D fixed to the movable platen 133 closer to the half A and finally close this pair. The half B fixed to the movable platen 133' and the half C are closed together simultaneously. In this mold closure state, the fiber preform 139 is handed from the half A to the half D. The fabricated molded article 140 held in the half D is ejected to a subsequent step by a prescribed means while the revolving platen 145 is revolving.

The operations for mold opening and closure in the production apparatus 100 according to the present embodiment are the same as in the apparatus of the embodiment shown in FIGS. 21A and 21B.

The embodiments shown in FIGS. 15 through 22 can be applied to production of plastic molded articles. In this application, a parison of a molten resin is inserted into the cavity of the first mold 110, and air is blown into the parison to obtain a blow molded article. The molded article is then subjected to fabrication in the second mold, such as filling the molded article with contents or coating the inner side of the molded article.

In the embodiment shown in FIGS. 15 to 20, fixing the halves B and D to the respective movable platens may be replaced by fixing them to a fixed platen. In this case, the slide platen 130 reciprocates with respect to the fixed platen to conduct mold closure and opening.

The time of ejecting a fabricated molded article 140 to send it to a next step is not limited to the mode of the above-described embodiments. The ejection can be timed between opening the halves C and D (after fabrication is conducted in the second mold 120 and while the molded article is held in either of the halves C and D by a prescribed means) and next closure of the halves C and D.

One or more than one additional molds may be added after the fabrication in the second mold to perform one or more fabrication steps. Transfer of a molded article between the steps can be carried out in the same manner as described above.

While in the embodiments shown in FIGS. 15 through 21, the movable platens 132 and 133 (and 132' and 133') are independent members, they may be replaced with an integral movable platen.

According to the embodiments of FIGS. 15 to 22, there are provided a method and an apparatus for producing a molded article which make it possible to subject a fiber preform to fabrication (drying under heat and pressure) while maintaining it in the state as molded. The molded article thus produced, having received no mechanical deforming force, does not suffer from unnecessary deformation, and there is no fear of misregistration of the fiber preform in a mold that is liable to occur in handling with an external handling device. Compared with apparatus using an external handling device, the apparatus has a smaller daylight between the halves during the transfer of the fiber preform or the molded article, which makes size reduction feasible, and involves a reduced number of steps, which leads to a reduction of production cycle.

INDUSTRIAL APPLICABILITY

The molded article of the present invention has a plurality of narrow ridges on its outer surface and therefore exhibits high shape retention on use and excellent handling properties with a handling device. The drying mold of the present invention and the method of producing a molded article according to the present invention make it possible to produce the molded article of the present invention with the above-stated effects stably and efficiently.

What is claimed is:

1. A method of producing a molded article which comprises a papermaking step in which a slurry containing fibers dispersed in a liquid is made into a wet fiber preform by use of a papermaking mold, a dewatering step in which said wet fiber preform is dewatered using at least one fluid passageway, and a drying step in which said dewatered undried fiber preform is dried by use of a drying mold, wherein said drying mold has a drying part the shape of which fits said undried fiber preform and which has a plurality of narrow fluid passageways of slit form which are formed directly in said drying part and interconnect said drying part and the outside of said mold, and said dewatered fiber preform is put into said drying mold, and pressed and dried to obtain a molded article having narrow ridges on the outer surface thereof at positions corresponding to said passageways.

2. The method of producing a molded article according to claim 1, wherein a flexible film is disposed on the inner side of said undried fiber preform which is put into said drying mold, and then said undried fiber preform is pressed and dried via said flexible film.

3. The method of producing a molded article according to claim 1, wherein:

said fiber preform is molded in a papermaking split mold split into two halves, said split mold is opened with said fiber preform being held in one of the halves by a prescribed means, said one of the halves of the papermaking mold is moved to a position where it faces one of a pair of said drying molds, said one of the halves of the papermaking mold and said one of the pair of the drying molds are closed together to hold said fiber preform in the closed mold, said fiber preform, while being in the closed mold, is released from the hold by said one of the halves of the papermaking mold and concurrently held in said one of the pair of the drying molds by a prescribed means, said closed mold is opened to transfer said fiber preform from said one of the halves of the papermaking mold to said one of the pair of the drying molds, said one of the pair of the drying molds and the other drying mold of the pair are closed together to hold said fiber preform in the closed mold, and said fiber preform is dried in said closed mold.

* * * * *